US010260833B1

(12) United States Patent
Rinker et al.

(10) Patent No.: US 10,260,833 B1
(45) Date of Patent: Apr. 16, 2019

(54) ADJUSTABLE PULLEY ASSEMBLY FOR A COMPOUND ARCHERY BOW

(71) Applicant: BowTech, Inc., Eugene, OR (US)

(72) Inventors: Dylan G. Rinker, Eugene, OR (US); Jack B. Smith, Veneta, OR (US)

(73) Assignee: BOWTECH, INC., Eugene, OR (US)

( * ) Notice: Subject to any disclaimer, the term of this patent is extended or adjusted under 35 U.S.C. 154(b) by 0 days.

(21) Appl. No.: 15/940,946

(22) Filed: Mar. 29, 2018

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105; Y10S 124/90
USPC ..... 124/25.6, 900
See application file for complete search history.

(56) References Cited

U.S. PATENT DOCUMENTS 4,519,374 A 5/1985 Miller
4,562,824 A 1/1986 Jennings
4,660,536 A 4/1987 McPherson
4,926,832 A 5/1990 Darlington
4,976,250 A 12/1990 Jeffrey
5,678,529 A 10/1997 Larson
5,782,229 A 7/1998 Evans et al.
5,791,322 A 8/1998 McPherson
5,934,265 A * 8/1999 Darlington ..... F41B 5/10 124/25.6
5,960,778 A 10/1999 Larson
5,975,067 A * 11/1999 Strother ..... F41B 5/10 124/25.6
6,067,974 A 5/2000 Islas
6,082,347 A 7/2000 Darlington
6,112,732 A 9/2000 Larson
6,155,243 A 12/2000 Gallops, Jr.
6,250,293 B1 * 6/2001 Andrews ..... F41B 5/10 124/25.6
RE37,544 E 2/2002 Darlington
6,360,735 B1 3/2002 Larson et al.
6,446,619 B1 9/2002 McPherson
6,460,528 B1 10/2002 Gallops, Jr.
6,474,324 B1 11/2002 Despart et al.
6,516,790 B1 2/2003 Darlington
6,575,153 B2 * 6/2003 Lommasson ..... F41B 5/10 124/25.6
6,691,692 B1 2/2004 Adkins
6,718,963 B1 4/2004 Wheeler
6,792,930 B1 9/2004 Kronengold et al.
6,871,643 B2 3/2005 Cooper et al.
6,966,312 B1 11/2005 Larson
6,976,484 B1 12/2005 Gallops, Jr.
(Continued)

*Primary Examiner* — Alexander R Niconovich
(74) *Attorney, Agent, or Firm* — David S. Alavi

(57) ABSTRACT

A pulley assembly for a compound bow comprises a draw cable pulley, a power cable pulley attached to the draw cable pulley, and a cable deflector attached to the power cable pulley or the draw cable pulley and adjustable among multiple deflector arrangements. The cable deflector engages the power cable during a let-off portion of drawing of the bow after the power cable is taken up by the power cable pulley. Different deflector arrangements result in corresponding draw force curves for the bow that differ from one another with respect to one or both of (i) draw force let-off rate with respect to draw distance or (ii) hold weight at full draw. The adjustment can be performed without using a bow press and without derigging the bow.

29 Claims, 16 Drawing Sheets

(56) References Cited

U.S. PATENT DOCUMENTS 6,990,970 B1 1/2006 Darlington
6,994,079 B1 2/2006 Darlington
7,082,937 B1 * 8/2006 Land ..... F41B 5/105 124/25.6
7,188,615 B2 3/2007 Chang
7,305,979 B1 * 12/2007 Yehle ..... F41B 5/10 124/25.6
7,311,098 B2 * 12/2007 Gallops, Jr. ..... F41B 5/10 124/25.6
7,441,555 B1 10/2008 Larson
7,673,626 B1 3/2010 Hennings
7,690,372 B2 * 4/2010 Cooper ..... F41B 5/10 124/25.6
7,721,721 B1 * 5/2010 Kronengold ..... F41B 5/105 124/16
7,770,568 B1 8/2010 Yehle
7,938,109 B1 5/2011 Larson
7,971,582 B1 7/2011 Larson
8,020,544 B2 * 9/2011 McPherson ..... F41B 5/105 124/25.6
8,069,848 B1 12/2011 Larson
8,082,910 B1 * 12/2011 Yehle ..... F41B 5/105 124/23.1
8,181,638 B1 5/2012 Yehle
8,205,607 B1 * 6/2012 Darlington ..... F41B 5/105 124/23.1
8,220,446 B2 * 7/2012 Batdorf ..... F41B 5/105 124/25.6
8,281,774 B2 10/2012 Grace
8,281,775 B1 10/2012 Larson
8,469,013 B1 * 6/2013 Obteshka ..... F41B 5/10 124/23.1
8,544,456 B2 10/2013 Grace
8,662,062 B2 * 3/2014 Darlington ..... F41B 5/10 124/23.1
8,671,925 B2 * 3/2014 Grace ..... F41B 5/105 124/25.6
8,683,989 B1 * 4/2014 McPherson ..... F41B 5/105 124/25.6
8,739,769 B1 6/2014 Obteshka et al.
9,121,658 B1 * 9/2015 Darlington ..... F41B 5/123
9,146,070 B2 * 9/2015 Langley ..... F41B 5/1434
9,261,321 B2 * 2/2016 Yi ..... F41B 5/105
9,347,730 B2 5/2016 Obteshka
9,354,017 B2 5/2016 McPherson
9,417,028 B2 * 8/2016 Hyde ..... F41B 5/105
9,423,202 B1 * 8/2016 Obteshka ..... F41B 5/105
9,441,907 B1 * 9/2016 Obteshka ..... F41B 5/105
9,506,714 B1 * 11/2016 Eacker ..... F41B 5/105
9,581,407 B2 * 2/2017 Yi ..... F41B 5/105
9,739,562 B1 * 8/2017 Obteshka ..... F41B 5/105
2002/0144675 A1 10/2002 Lommasson et al.
2004/0003806 A1 * 1/2004 Blahnik ..... F41B 5/10 124/25.6
2004/0074485 A1 4/2004 Cooper et al.
2005/0193998 A1 9/2005 Cooper et al.
2005/0268892 A1 12/2005 Gallops
2006/0000463 A1 1/2006 Gallops
2009/0188482 A1 * 7/2009 Strother ..... F41B 5/10 124/25.6
2010/0051005 A1 * 3/2010 Wilson ..... F41B 5/10 124/25.6
2010/0212647 A1 8/2010 Eee et al.
2013/0074819 A1 * 3/2013 McPherson ..... F41B 5/105 124/25.6
2015/0345890 A1 * 12/2015 McPherson ..... F41B 5/105 124/25.6
2015/0377581 A1 * 12/2015 Obteshka ..... F41B 5/105 124/25.6

* cited by examiner

ADJUSTABLE PULLEY ASSEMBLY FOR A COMPOUND ARCHERY BOW

FIELD OF THE INVENTION

The field of the present invention relates to a pulley assembly for a compound archery bow. In particular, an adjustable pulley assembly is disclosed herein having an adjustable cable deflector for providing fine adjustment of one or both of (i) draw force let-off rate with respect to draw distance of the archery bow or (ii) hold weight of the archery bow at full draw.

BACKGROUND

Several adjustable pulley assemblies are available for compound archery bows. Some examples are disclosed in: U.S. Pat. No. 8,020,544 entitled "Archery bow with force vectoring anchor" issued Sep. 20, 2011 to McPherson; U.S. Pat. No. 8,082,910 entitled "Pulley assembly for a compound archery bow" issued Dec. 27, 2011 to Yehle; U.S. Pat. No. 9,347,730 entitled "Adjustable pulley assembly for a compound archery bow" issued May 24, 2016 to Obteshka; U.S. Pat. No. 9,417,028 entitled "Adjustable pulley assembly for a compound archery bow" issued Aug. 16, 2016 to Hyde et al.; U.S. Pat. No. 9,441,907 entitled "Adjustable pulley assembly for a compound archery bow" issued Sep. 13, 2016 to Obteshka; U.S. Pat. No. 9,506,714 entitled "Adjustable pulley assembly for a compound archery bow" issued Nov. 29, 2016 to Eacker et al.; and U.S. Pat. No. 9,739,562 entitled "Adjustable pulley assembly for a compound archery bow" issued Aug. 22, 2017 to Obteshka.

SUMMARY

A pulley assembly for a compound archery bow comprises a draw cable pulley, a power cable pulley substantially rigidly attached to the draw cable pulley, and an adjustable cable deflector substantially rigidly attached to the power cable pulley or the draw cable pulley. The draw cable pulley is structurally arranged so as to (i) define a first pulley assembly transverse rotation axis, (ii) be mounted on a first limb of an archery bow to rotate about the first pulley assembly axis, and (iii) let out, from a circumferential draw cable journal of the draw cable pulley, a draw cable of the archery bow when the bow is drawn and the draw cable pulley rotates about the first pulley assembly axis. The power cable pulley is structurally arranged and positioned on the draw cable pulley so as to take up, during at least a portion of drawing of the bow, into a circumferential power cable journal of the power cable pulley, a power cable of the archery bow. One or more of the cable deflector, the power cable pulley, or the draw cable pulley are structurally arranged so as to enable substantially rigid attachment of the cable deflector to the power cable pulley or the draw cable pulley in any one of a set of multiple deflector arrangements. For at least one of the multiple deflector arrangements, the power cable pulley and the cable deflector are structurally arranged so that the cable deflector engages the power cable for further take-up thereof during a let-off portion of drawing of the bow after the power cable is taken up by the power cable pulley. The power cable pulley and the cable deflector are structurally arranged so that at least two of the multiple deflector arrangements result in corresponding draw force curves for the bow that differ from one another with respect to one or both of (i) draw force let-off rate with respect to draw distance or (ii) hold weight at full draw.

A method for adjusting the pulley assembly described above comprises moving the cable deflector from a first one of the multiple deflector arrangements and substantially rigidly attaching the cable deflector to the power cable pulley or the draw cable pulley in a second, different one of the multiple deflector arrangements, thereby altering one or both of the let-off rate or the hold weight. In some instances the method can be performed without derigging the bow and without using a bow press.

An archery bow comprises a central riser, first and second bow limbs secured to opposing ends of the riser, first and second pulley assemblies rotatably mounted on the first and second bow limbs, respectively, a draw cable, and a power cable. One or both of the pulley assemblies are arranged as described above.

Objects and advantages pertaining to pulley assemblies for compound archery bows may become apparent upon referring to the example embodiments illustrated in the drawings and disclosed in the following written description or appended claims, and shall fall within the scope of the present disclosure.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It should be noted that the embodiments depicted are shown only schematically, and that not all features may be shown in full detail or in proper proportion. Certain features or structures may be exaggerated relative to others for clarity. It should be noted further that the embodiments shown are examples only, and should not be construed as limiting the scope of the present disclosure or appended claims.

DETAILED DESCRIPTION OF EMBODIMENTS

Figure 1:
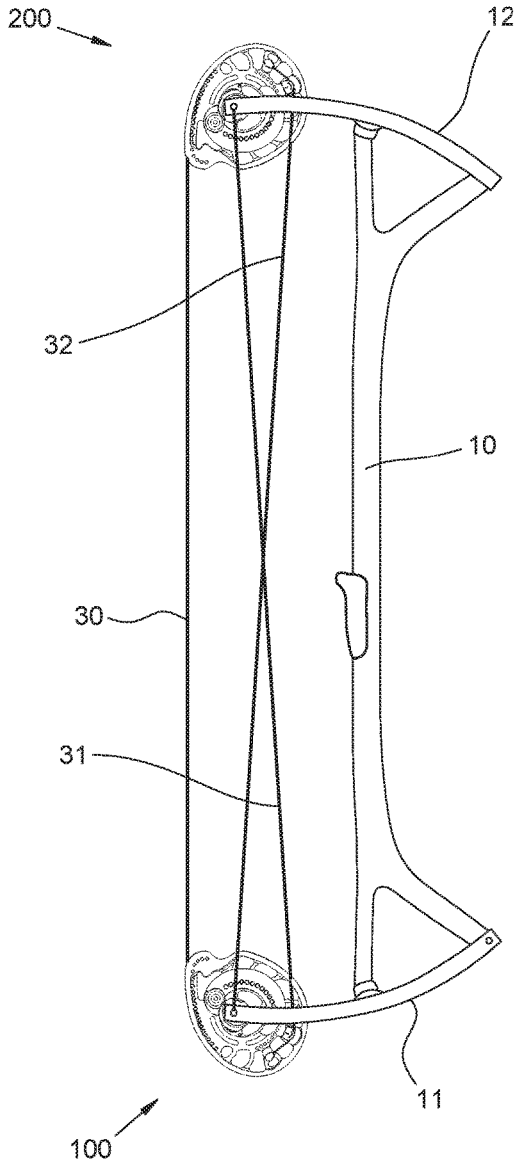
FIG. 1 illustrates schematically an example of a so-called dual cam archery bow incorporating an example inventive pulley assembly.
Figure 2:
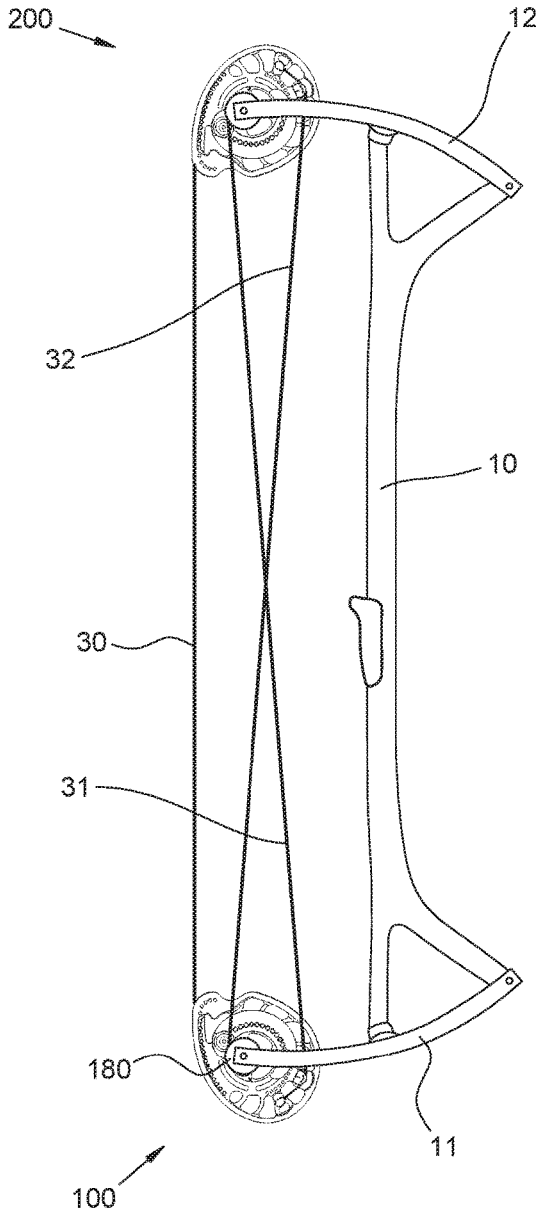
FIG. 2 illustrates schematically an example of a so-called binary cam archery bow incorporating an example inventive pulley assembly.

A compound archery bow comprises a central riser 10, first and second bow limbs 11 and 12 secured to opposing ends of the riser 10, first and second pulley assemblies 100 and 200 rotatably mounted on the first and second bow limbs 11 and 12, respectively, a draw cable 30, and a power cable 31. If the bow is a so-called dual cam bow (FIG. 1) or a so-called binary cam bow (FIG. 2), then the bow includes a second power cable 32 and the first and second pulley assemblies 100 and 200 are substantially identical or substantial mirror images of each other. Upon drawing a dual cam bow, the draw cable 30 is let out by both pulley assemblies 100 and 200, the power cable 31 (which is attached, directly or indirectly, to the second bow limb 12) is taken up by the first pulley assembly 100, and the second power cable 32 (which is attached, directly or indirectly, to the first bow limb 11) is taken up by the second pulley assembly 200. Upon drawing a binary cam bow, the draw cable 30 is let out by both pulley assemblies 100 and 200, the power cable 31 is let out by the second pulley assembly 200 and taken up by the first pulley assembly 100, and the second power cable 32 is let out by the first pulley assembly 100 and taken up by the second pulley assembly 200.

Figure 3:
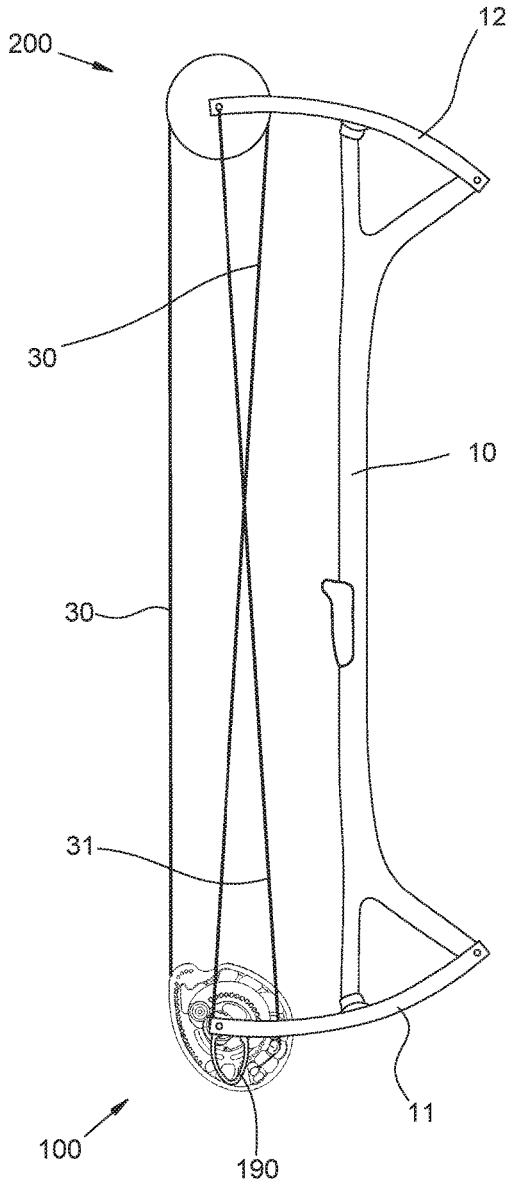
FIG. 3 illustrates schematically an example of a so-called solo cam archery bow incorporating an example inventive pulley assembly.
Figure 4:
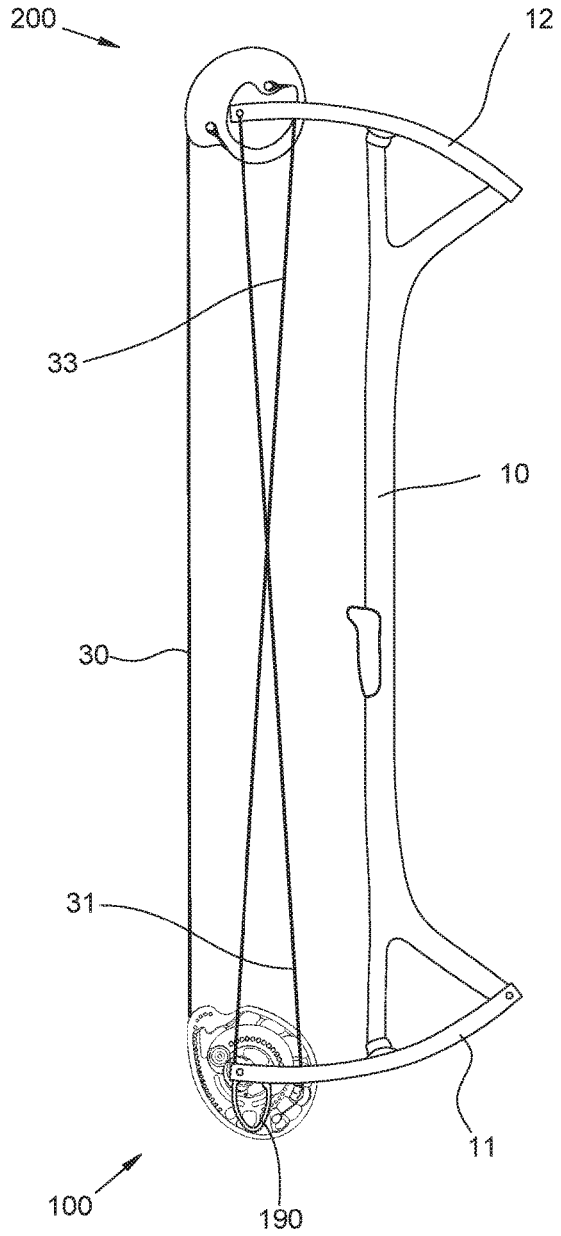
FIG. 4 illustrates schematically an example of a so-called hybrid cam archery bow incorporating an example inventive pulley assembly.

If the bow is a so-called solo cam bow (FIG. 3), then the second pulley assembly 200 comprises an idler wheel and the draw cable 30 passes around the idler wheel and is connected at both ends to the first pulley assembly 100. Upon drawing a solo cam bow, the both ends of the draw cable are let out by the first pulley assembly 100. The power cable 31 is taken up at its first end by the first pulley assembly 100; the second end of the power cable 31 typically is attached, directly or indirectly to the second bow limb 12; in some examples the power cable 31 instead can be let out by the second pulley assembly 200. If the bow is a so-called hybrid cam bow (FIG. 4), then the bow includes an additional coupling cable 33 connected to the first and second pulley members 100 and 200. Upon drawing a hybrid cam bow, the draw cable 30 is let out by both pulley assemblies 100 and 200 and the coupling cable 33 is let out by the first pulley assembly 100 and taken up by the second pulley assembly 200. The power cable 31 is taken up at its first end by the first pulley assembly 100; the second end of the power cable 31 typically is attached, directly or indirectly to the second bow limb 12; in some examples the power cable 31 instead can be let out by the second pulley assembly 200.

The inventive pulley assemblies disclosed herein, or equivalents thereof, can be advantageously employed with any type of compound archery bow, including dual cam, binary cam, solo cam, and hybrid cam bows described above. In a dual or binary cam bow, inventive pulley assemblies can be employed for both pulley assemblies; in a solo or hybrid cam bow, an inventive pulley assembly can be employed for only one pulley assembly, or in some instances of a hybrid cam bow for both pulley assemblies.

Figure 5A:
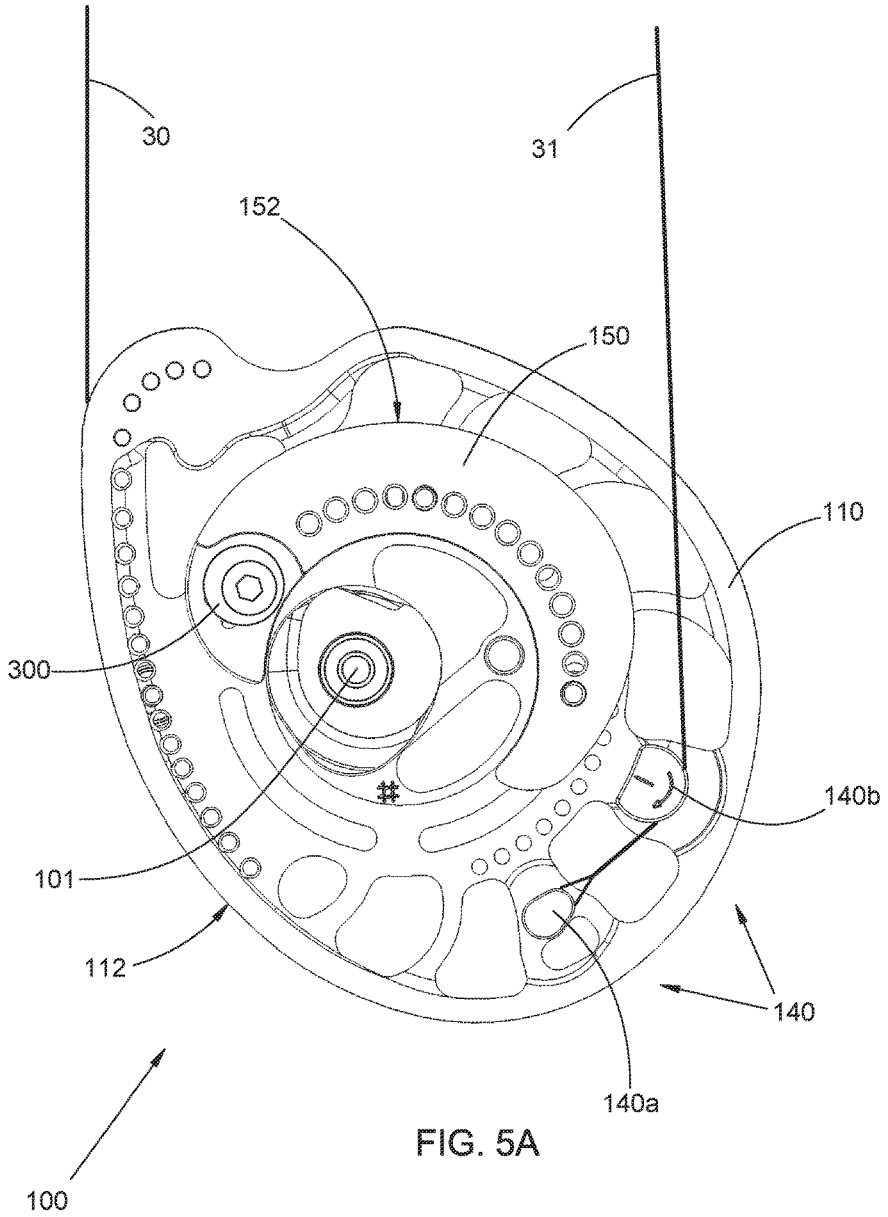
FIGS. 5A-5C are schematic side views of an example inventive pulley assembly in three different example arrangements with the bow at brace.
Figure 5B:
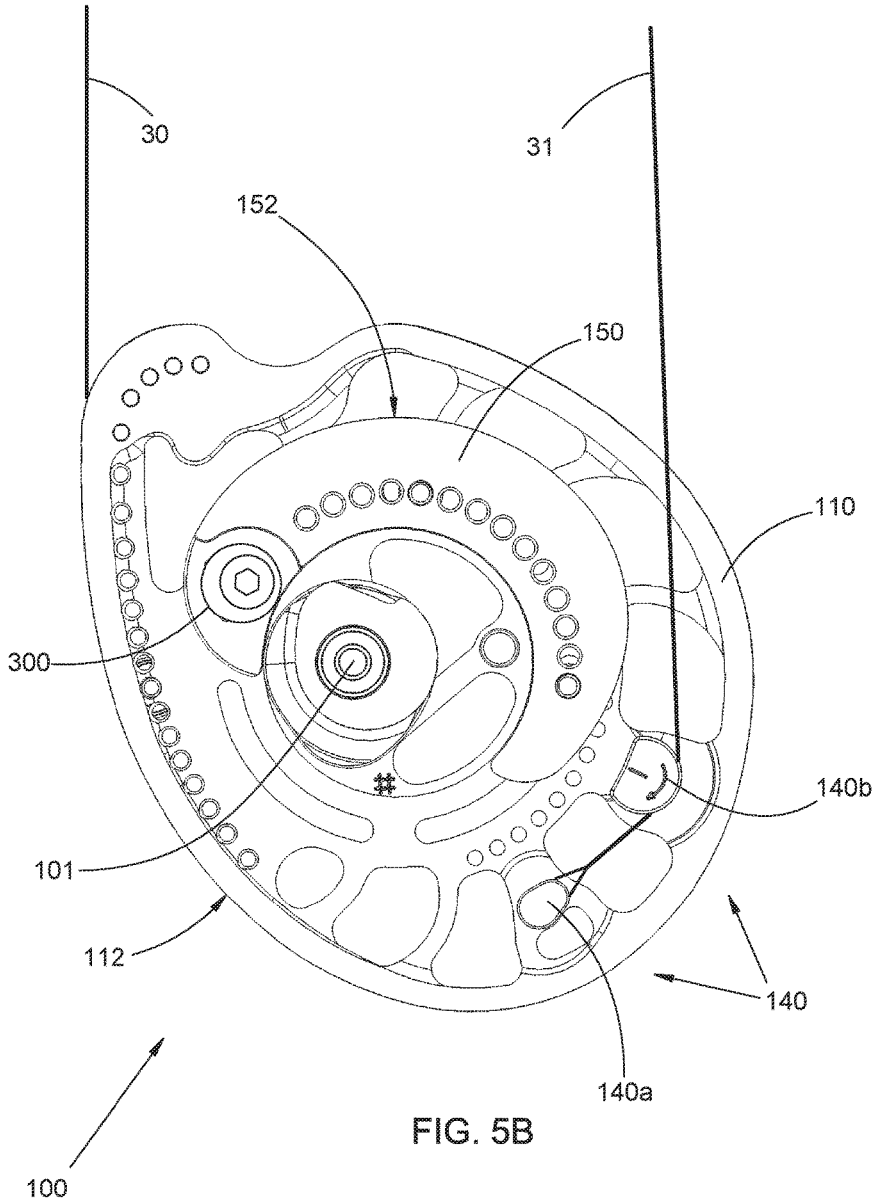
Figure 5C:
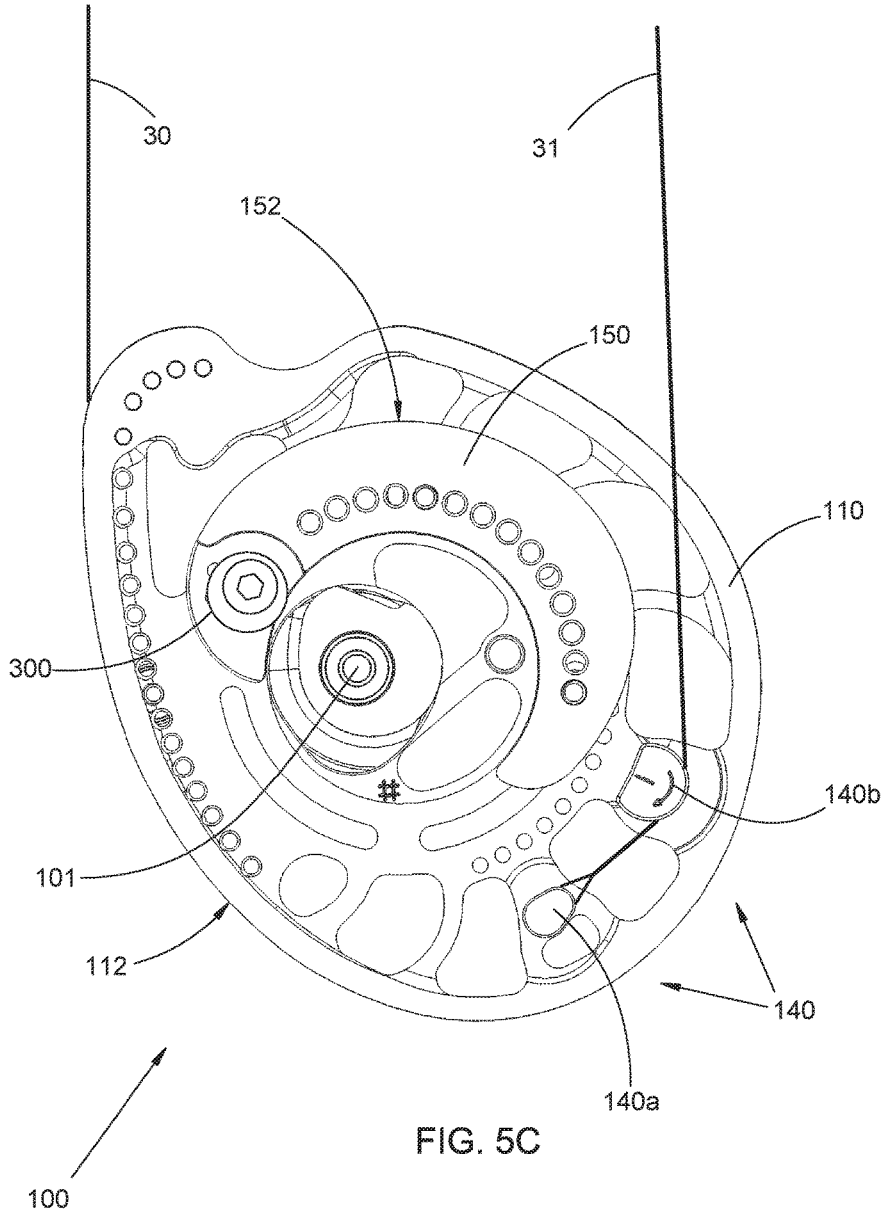
Figure 6A:
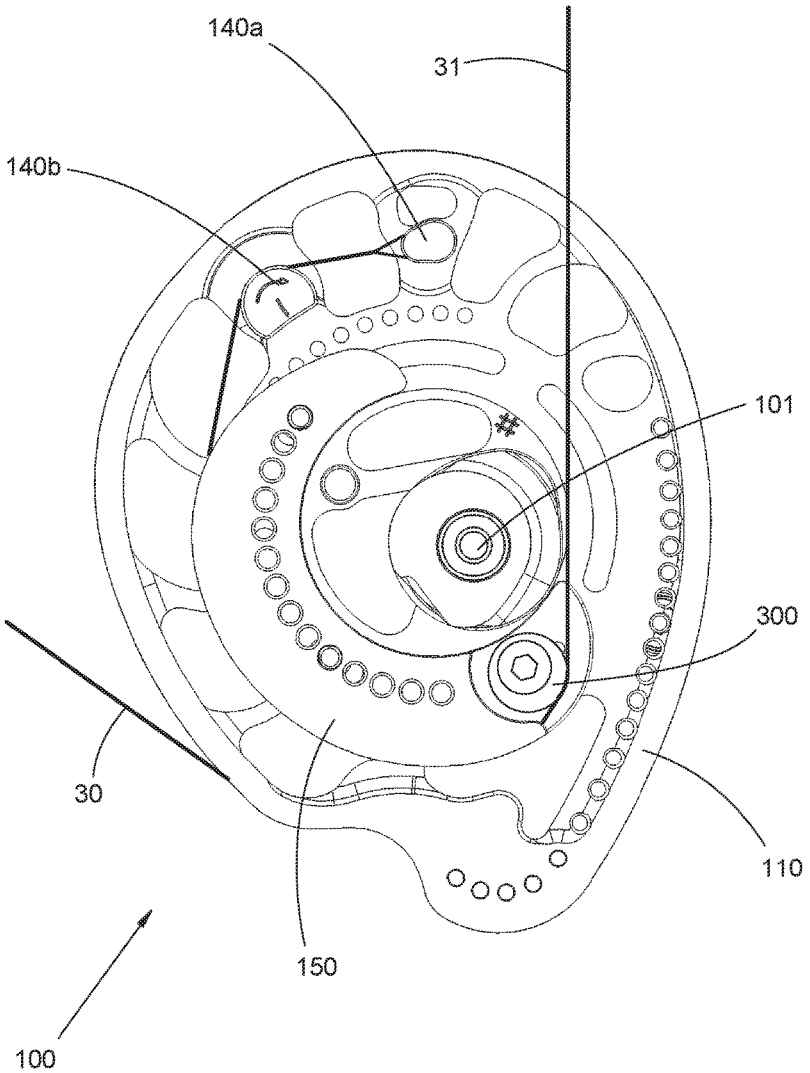
FIGS. 6A-6C are schematic side views of an example inventive pulley assembly in the three different example arrangements of FIGS. 5A-5C, respectively, with the bow at full draw.
Figure 6B:
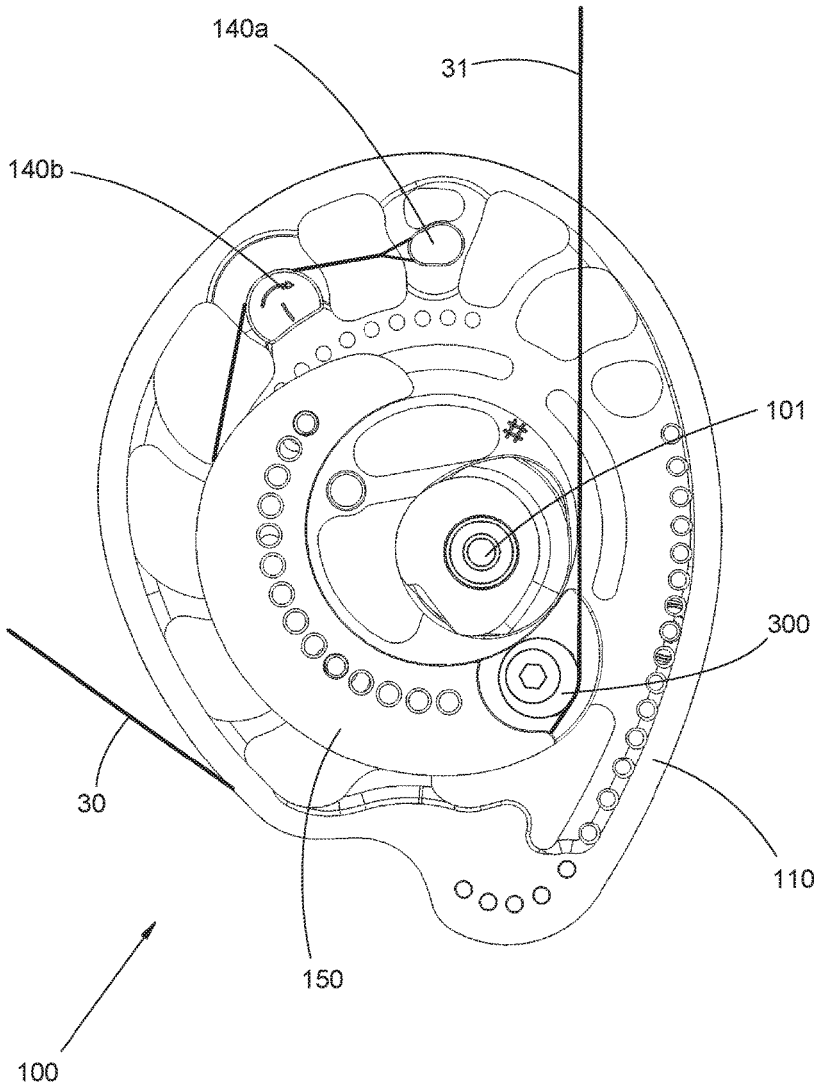
Figure 6C:
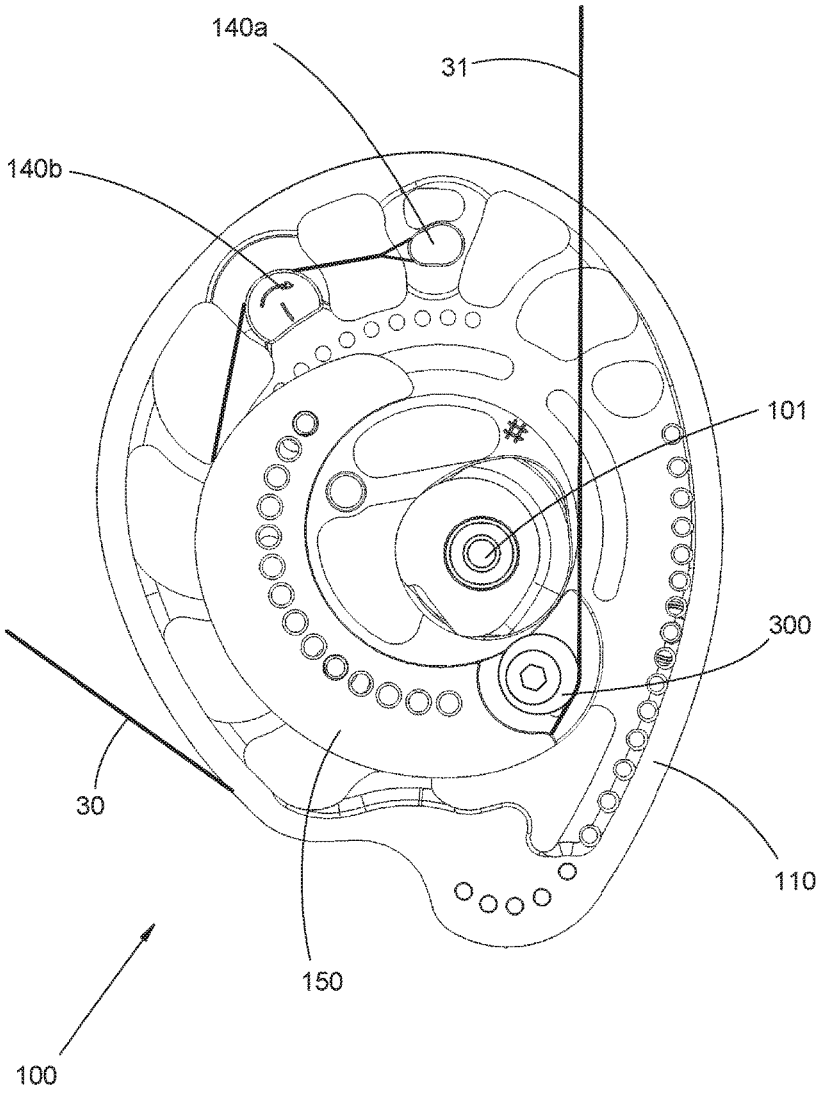

An example of an inventive pulley assembly 100 is shown in FIGS. 5A through 5C (with the bow 10 at brace) and FIGS. 6A through 6C (with the bow 10 at full draw). As noted above, the pulley assembly 200 in a dual or hybrid cam bow can be substantially identical or a substantial mirror image of the pulley assembly 100, and the following description can apply to both pulley assemblies 100 and 200 in such cases. The pulley assembly 100 comprises a draw cable pulley 110, a power cable pulley 150 substantially rigidly attached to the draw cable pulley 110, and a cable deflector 300 substantially rigidly attached to the power cable pulley 150 or the draw cable pulley 110. Each of those elements can be fabricated in any suitable way from any one or more suitably strong and rigid materials; such elements are commonly fabricated by machining from aluminum; other materials or fabrication methods can be employed. The draw cable pulley 110 defines a first pulley assembly transverse rotation axis 101 and is mounted on the limb 11 in any suitable manner to rotate about the first pulley assembly axis 101. "Transverse" in the context of the present disclosure refers to a direction that is substantially perpendicular to a virtual plane in which the draw cable 30 moves as the bow is drawn (often referred to as the shooting plane); the first pulley assembly axis 101 is substantially perpendicular to that virtual plane. Suitable mounting arrangements can include one or more of, e.g., an axle passing through the draw cable pulley 110, one or more axle segments integrally formed on the draw cable pulley 110, rotational bearings on the draw cable pulley 110 or on the limb 11, and so on; some examples are disclosed by U.S. Pat. Nos. 8,469,013, 8,739,769, and 9,683,806, which are incorporated by reference. The draw cable pulley 110 includes a circumferential draw cable journal or groove 112 arranged around at least a portion of its periphery.

A first end of the draw cable 30 is secured to the draw cable pulley 110 in any suitable way and received in the draw cable journal 112. The draw cable pulley 110 lets out the first end of the draw cable 30 from the draw cable journal 112 when the bow is drawn and the draw cable pulley 110 rotates about the first pulley assembly axis 101. The draw cable pulley 110 can be eccentrically mounted (relative to the first pulley assembly axis 101) or non-circular so as to act as a cam as it lets out the draw cable 30.

The power cable pulley 150 is substantially rigidly attached to the draw cable pulley 110 in any suitable manner. In some examples, the draw cable pulley 110 and the power cable pulley 150 can be integrally formed; in other examples the draw cable pulley 110 and the power cable pulley 150 can be formed as separate parts and then assembled together in any suitable way (directly attached, or attached using an intermediate mounting member). In those examples having separate draw cable and power cable pulleys 110/150, the draw cable pulley 110 and the power cable pulley 150 can be attached in only a single fixed arrangement (i.e., relative position and orientation), or one or both of the draw cable pulley 110 or the power cable pulley 150 (or a mounting member, if employed) can be structurally arranged so as to enable substantially rigid attachment of the power cable pulley 150 to the draw cable pulley 100 in any one of multiple power cable pulley arrangements (i.e., relative position or orientation). Each one of those multiple power cable pulley arrangements can result in one or more of: (i) a corresponding draw length of the bow that differs from a draw length resulting from at least one different power cable pulley arrangement; (ii) a corresponding draw weight of the bow that differs from a draw weight resulting from at least one different power cable pulley arrangement; (iii) corresponding stored energy of the drawn bow that differs from stored energy of the drawn bow resulting from at least one different power cable pulley arrangement; or (iv) a corresponding dependence of draw force on draw distance of the bow that differs from a dependence of draw force on draw distance resulting from at least one different power cable pulley arrangement. Examples are disclosed in co-owned U.S. Pat. Nos. 9,347,730; 9,417,028; and 9,506,714, which are incorporated by reference as if fully set forth herein.

The power cable pulley 150 has a circumferential power cable journal or groove 152 arranged around at least a portion of its periphery. The power cable pulley 150 is structurally arranged so as to receive the power cable 31 in the circumferential power cable journal 152 and to take up the power cable 31 when the bow is drawn and the draw cable pulley 110 rotates about the first pulley assembly axis 101. In some examples the power cable pulley 150 has two circumferential grooves (e.g., as in U.S. Pat. No. 9,506,714); which of those grooves lets out the power cable 31 depends on the orientation of power cable pulley 150 when it is attached to the draw cable pulley 110. The power cable pulley 150 typically is eccentrically mounted (relative to the first pulley assembly axis 101) or non-circular so as to act as a cam as it takes up the power cable 31. Some examples of suitable arrangements are disclosed in co-owned U.S. Pat. Nos. 7,305,979; 7,770,568; 8,181,638; 8,469,013; 8,739,769; 9,347,730; 9,417,028; 9,441,907; 9,506,714; and 9,739,562. Each of those patents is incorporated by reference as if fully set forth herein.

In some examples of an inventive pulley assembly 100, including those shown in the drawings, the draw cable pulley 110 can be structurally arranged so as to include a power cable anchor 140*a*. In the example shown, an end loop of the power cable 31 is placed on the power cable anchor 140*a* (in the form of a primary post), and the power cable 31 spans the distance between the power cable anchor 140*a* and a secondary post 140*b* and at least partly wraps around the secondary post 140*b*. In the examples shown, the segment of the power cable 31 between the anchor 140*a* and the post 140*b* does not move relative to the draw cable pulley 110 as the bow is drawn. Other suitable arrangements of the anchor (not shown) can be employed in other examples of an inventive pulley assembly, e.g., only a single post for anchoring a power cable end loop, or a primary post and multiple secondary posts around which the power cable 31 is at least partly wrapped.

In the examples shown, with the bow 10 at brace and also during an earlier phase of drawing the bow 10, the power cable pulley 150 is arranged so that it does not make contact with any portion of the power cable 31. At some intermediate point of the bow's draw, the power cable pulley makes contact with the power cable 31. After that point, during a later phase of drawing the bow, the power cable 31 makes contact with and is taken up by the circumferential power cable journal 152 of the power cable pulley 150. In another examples (not shown), the power cable 31 is in contact with the power cable pulley 150 at brace and throughout drawing of the bow as the power cable 31 is taken up in the groove 152. Both of those types of arrangements shall fall within the scope of the present disclosure or appended claims.

Figure 8A:
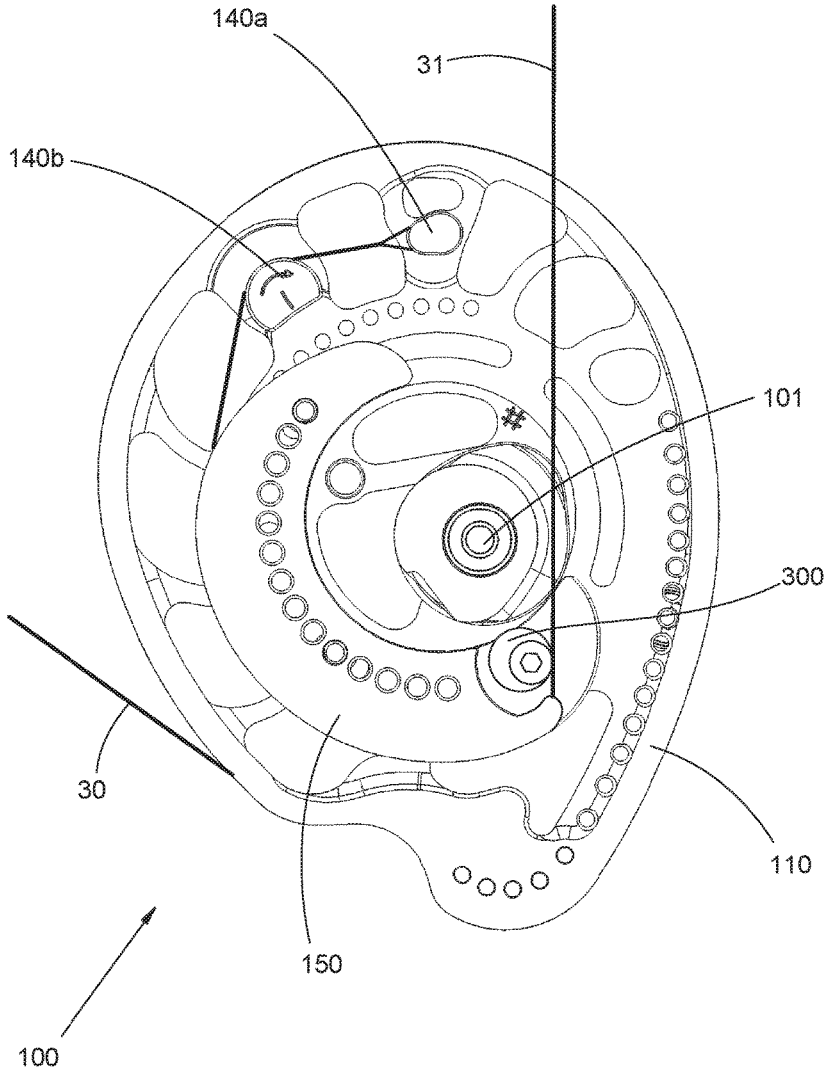
FIGS. 8A and 8B are schematic side views of another example inventive pulley assembly in two different example arrangements with the bow at full draw.
Figure 8B:
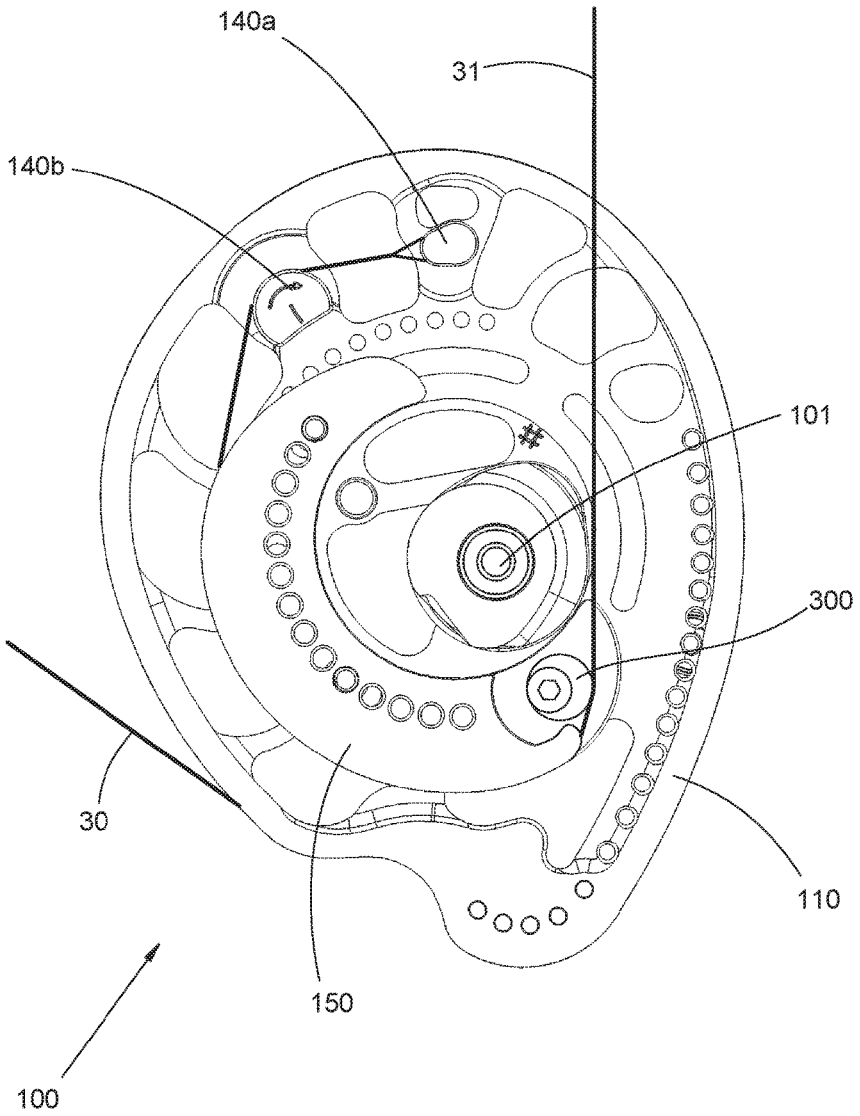

One or more of the cable deflector 300, the power cable pulley 150, or the draw cable pulley 110 are structurally arranged so as to enable substantially rigid attachment of the cable deflector 300, in any one of a set of multiple deflector arrangements, to the power cable pulley 150 or the draw cable pulley 110. In the examples shown, the cable deflector 300 is attached directly to the power cable pulley 150. Three different deflector arrangements for an example pulley assembly 100 are shown in FIGS. 5A-5C (with the bow at brace) and in FIGS. 6A-6C (with the bow at full draw). Two different deflector arrangements for another example pulley assembly 100 are shown in FIGS. 8A and 8B (with the bow at full draw). For at least one of the multiple deflector arrangements, the power cable pulley 150 and the cable deflector 300 are structurally arranged so that the cable deflector 300 engages the power cable 31, for further take-up of the power cable 31, during a let-off portion of drawing of the bow after the power cable 31 is taken up by the power cable pulley 150. The power cable pulley 150 and the cable deflector 300 are structurally arranged so that at least two of the multiple deflector arrangements result in corresponding draw force curves for the bow that differ from one another with respect to one or both of (i) draw force let-off rate with respect to draw distance or (ii) hold weight at full draw.

Figure 10:
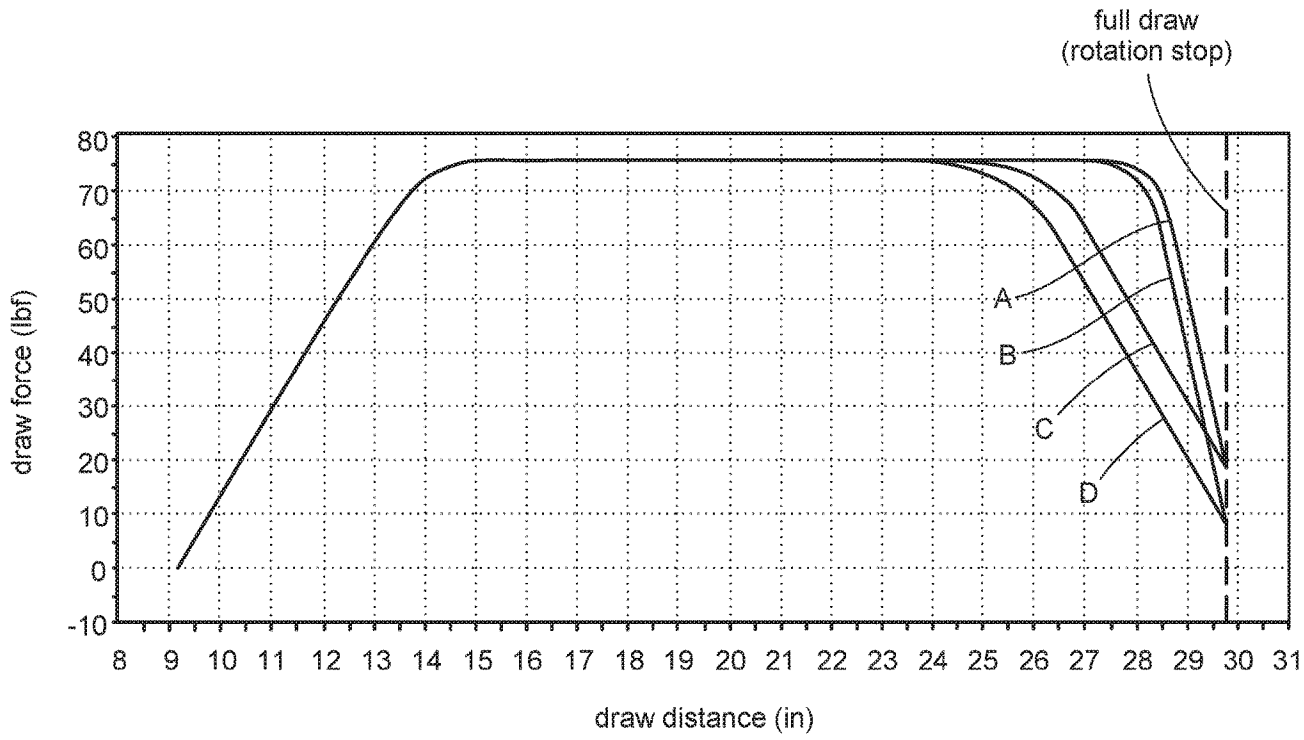
FIG. 10 shows several example draw force curves resulting from different deflector arrangements of an example inventive pulley assembly incorporated into an archery bow.

The draw force curve is a plot of draw weight versus draw distance for an archery bow; several examples are shown in FIG. 10. The draw force curves of FIG. 10 are representative examples among myriad different draw force curves that can be exhibited by a compound archery bow, depending on size, arrangement, and stiffness of the limbs 11 and 12, and the specific sizes, shapes, and relative arrangements of the draw cable pulley 110, the power cable pulley 150, and the cable deflector 300. The curves of FIG. 10 should not be construed as limiting the scope of the present disclosure or appended claims. The let-off portion of the draw force curve corresponds to that latter portion of drawing the bow when the draw force decreases relatively rapidly with increasing draw distance; the slope of the let-off portion of the draw force curve is referred to herein as the draw force let-off rate. In some examples the let-off rate is substantially constant during much of the let-off portion of drawing the bow (e.g., as in the example curves of FIG. 10), while in other examples the let-off rate can vary during the let-off portion of drawing the bow; both of those behaviors fall within the scope of the present disclosure or appended claims. The so-called hold weight of the bow is the force required to hold the bow at full draw, and is represented by the far right end point of each of the curves of FIG. 10. In the example bows shown, the hold weight is the force that must be exerted by the archer to hold the bow at full draw. Inventive pulley assemblies can also be used in a crossbow (not shown); varying the hold weight can in turn vary the pull weight of a trigger mechanism of the crossbow. The curves of FIG. 10 (which do not extend beyond the full draw distance) can result from use of a hard rotation stop attached to the pulley assembly 100 to prevent its rotation beyond a certain angle (corresponding to the full draw distance). In other examples (not shown), the draw force curve goes through a minimum at the full draw distance and then increases relatively rapidly as the bow is drawn beyond that point.

In the example curves of FIG. 10: (i) curves A and B exhibit let-off rates similar to one another but differing hold weights (A>B); (ii) curves C and D also exhibit let-off rates similar to one another (and less than the let-off rate of curves A and B) but differing hold weights (C>D); (iii) curves A and C exhibit similar hold weights and differing let-off rates (A>C); (iv) curves B and D exhibit similar hold weights (which are less than those of curves A and C) and differing let-off rates (B>D); (v) curves A and D differ with respect to both let-off rate and hold weight; and (vi) curves B and C differ with respect to both let-off rate and hold weight. Each of those different draw force curves, and others not shown, can result from corresponding different arrangements of the cable deflector 300 on the inventive pulley assembly 100.

A method for adjusting the pulley assembly 100 comprises moving the cable deflector 300 from a first one of the multiple deflector arrangements and substantially rigidly attaching the cable deflector 300 to the power cable pulley 150 or the draw cable pulley 110 in a second, different one of the multiple deflector arrangements, thereby altering one or both of the let-off rate or the hold weight. Because the cable deflector 300 only engages the power cable 31 during the let-off portion of drawing the bow, the cable deflector 300 can be moved and attached with the bow at brace, without using a bow press and without derigging the bow. Note that engagement of the cable deflector 300 with the power cable 31 "during the let-off portion of drawing the bow" can include deflector arrangements wherein that engagement occurs during the entire let-off portion of drawing the bow, or during only part of the let-off portion of drawing the bow. If the hold weight differs between two given deflector arrangements, then engagement occurs at full draw for at least one of those deflector arrangements. If the let-off rate differs between two given deflector arrangements, then engagement occurs before full draw for at least one of those arrangements.

The draw force at any given draw distance depends on the relative effective lever arms of (i) the draw cable 30 as it is let out by the draw cable pulley 110 and (ii) the power cable 31 as it is taken up by the power cable pulley 150. Movement of the cable deflector 300 among the different cable arrangements results in differing let-off rate or hold weight by altering the effective lever arm for take-up of the power cable 31. For example, two deflector arrangements that differ with respect to the hold weight have differing effective lever arms, at full draw, for take-up of the power cable 31. Differing effective lever arms (i.e., perpendicular distance between the power cable 31 and the rotation axis 101) are readily observed in, e.g., FIG. 6A versus FIG. 6B, or in FIG. 8A versus FIG. 8B. Similarly, two deflector arrangements that differ with respect to let-off rate have differing rates of decrease, with respect to draw distance, of the effective lever arm for take-up of the power cable 31. Those differences are less readily discerned from the drawings, but one can observe that different deflector arrangements result in initial engagement of the cable deflector 150 and the power cable 31 at different rotation angles of the pulley assembly 100, e.g., FIGS. 5A/6A versus FIGS. 6B/6B versus FIGS. 5C/6C, or FIG. 8A versus FIG. 8B.

In some examples (e.g., as in FIGS. 5A-5C and 6A-6B), engagement of the power cable 31 with the cable deflector 300, during the let-off portion of drawing the bow, occurs for two or more different deflector arrangements, and at least two of those deflector arrangements differ from one another with respect to let-off rate or hold weight. In some other examples (e.g., as in FIGS. 8A and 8B), for at least one deflector arrangement, the cable deflector 300 does not engage the power cable 31 during any portion of drawing of the bow (e.g., as in FIG. 8A). Note that lack of "engagement" of the power cable 31 with the cable deflector 300 does not necessarily imply complete lack of contact, but only that no deflection of the power cable 31, or only negligible deflection, occurs during any part of drawing the bow. The deflector arrangement with no or negligible deflector engagement differs from at least one other deflector arrangement with respect to let-off rate or hold weight.

Figure 7A:
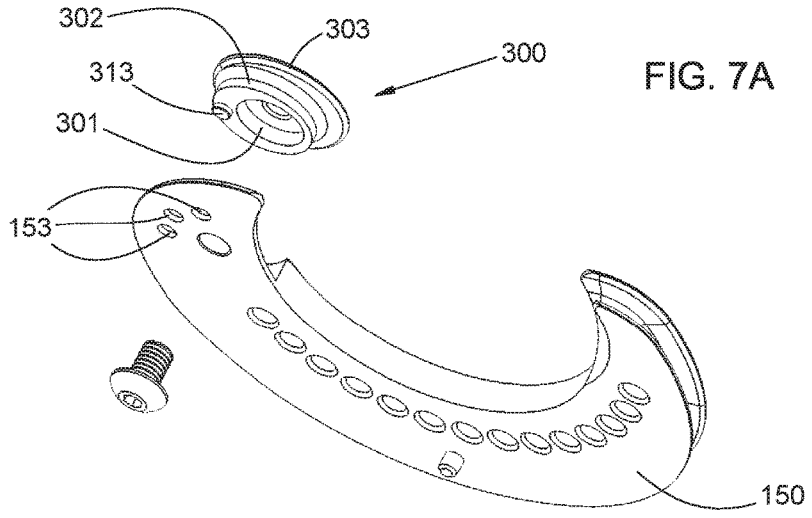
FIGS. 7A and 7B illustrate schematically one example of mechanically indexed engagement of an example cable deflector with an example power cable pulley.
Figure 7B:
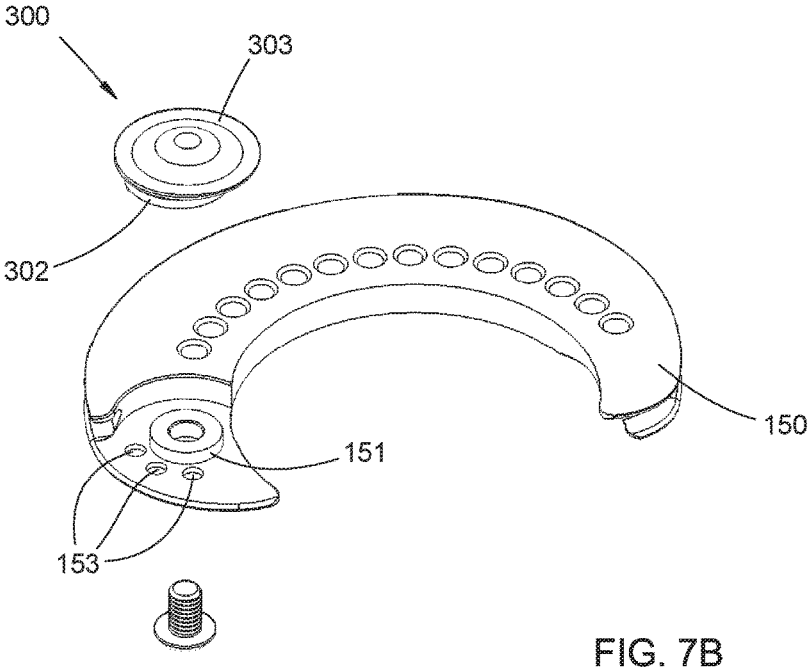

One example of a cable deflector 300 is illustrated schematically in FIGS. 7A and 7B. In that example, the cable deflector 300 comprises a concentric mounting portion (in the form of a recessed inner circumferential surface 301 in the example shown) and an eccentric deflector portion (in the form of an outer circumferential surface 302 in the example shown). Those deflector and mounting portions can be integrally formed or can be separate parts assembled together. The eccentric deflector portion can take the form of a pin, rod, post, knob, lug, disk, or other suitably shaped member suitably arranged for engaging the power cable 31. Similarly, the concentric mounting portion can take the form of a hole, cavity, pin, rod, knob, lug, disk, or other suitably shaped structure suitably arranged for engaging a suitably arranged mating structure on the power cable pulley 150 or the draw cable pulley 110. An upper cap or retainer portion is 303 is shown in FIGS. 7A and 7B but is omitted from the other drawings so as not to obscure the engagement of the power cable 31 with the cable deflector 300; such a cap or retainer can be included in some examples of an inventive pulley assembly, or can be absent from other examples.

In the example shown, the concentric mounting portion 301 fits over a protruding, mating mounting member 151 on the power cable pulley 150. The eccentric arrangement of the deflector portion 302 relative to the mounting portion 301 enables movement of the deflector portion 302 (relative to the pulley assembly 100) by rotation of the cable deflector 300 with the mounting portion 301 mated with the mounting member 151. Different deflector arrangements correspond to different rotational positions of the deflector 300 on the pulley assembly 100 (e.g., as in FIGS. 5A through 5C, FIGS. 6A through 6C, or FIGS. 8A and 8B). A screw or other suitable fastener can be employed to fix the cable deflector's position once a rotational position is selected and the cable deflector 300 is rotated to that selected position.

In other examples (not shown), the mounting portion 301 and a mating mounting member on the power cable pulley 150 or on the draw cable pulley 110 can be arranged in any suitable way to enable the cable deflector 300 to function as described or claimed herein. Any other suitable arrangement can be employed for implementing a cable deflector 300, including, e.g.: a translatable or rotatable deflector member slidable along a flat surface of the draw cable pulley 110 or movable along a slot, groove, spline, ribs, or track or groove on draw cable pulley 110. Any suitable fastener can be employed to fix the cable deflector's position once a position or orientation is selected and the cable deflector 300 is moved to that selected position.

In some examples, the set of multiple deflector arrangements comprises a continuous range of positions or orientations of the cable deflector 300 relative to the draw cable pulley 110. In some the examples (e.g., the example shown in FIGS. 8A and 8B), the circular shape of the mounting portion 301 can permit a continuous range of relative orientations of the cable deflector 300 on the circular mounting member 151 on the power cable pulley 150. In some other examples (e.g., the examples shown in FIGS. 5A-5C, 6A-6C, 7A, and 7B), the set of multiple deflector arrangements comprises a set of discrete positions or orientations of the cable deflector 300 relative to the power cable pulley 150 or the draw cable pulley 110. In some of those latter examples, the power cable pulley 150, the draw cable pulley 110, or the cable deflector 300 can be structurally arranged so as to provide mechanical indexing of each one of the multiple, discrete positions or orientations of the cable deflector 300 relative to the draw cable pulley 110. Such indexing can be implemented in any suitable way, e.g., a series of holes for fasteners, pins, or posts, a series of slots, ribs, splines, or grooves, and so on. In the example shown in FIGS. 5A-5C and 6A-6B, and most clearly in FIGS. 7A and 7B, the power cable pulley 150 includes a set of holes 153, and the cable deflector 300 includes a pin 313. The holes 153 and the pin 313 are structurally arranged so as to mechanically index a set of multiple, discrete relative rotational positions of the cable deflector 300 relative to the pulley assembly 100, by insertion of the pin 313 into a corresponding one of the holes 153. A set of continuous positions/orientations of the cable deflector 300 can provide finer adjustment of the amount of cable deflection; a set of discrete positions/orientations, particularly with mechanical indexing, can provide more reproducible adjustment, and can increase resistance of the cable deflector to unwanted movement due to lateral forces applied by the deflected cable 31.

As noted above, the disclosed inventive pulley assemblies can be employed with any type of compound archery bow, including dual cam, binary cam, solo cam, and hybrid cam bows. In dual or binary cam bows (FIGS. 1 and 2, respectively), the second pulley assembly 200 (rotatably mounted on limb 12) typically is substantially identical to or a substantial mirror image of the first pulley assembly 100 already described. The power cable 32 is taken up by the power cable pulley of the second pulley assembly 200 as the bow is drawn and the second pulley assembly 200 rotates about a corresponding second pulley assembly axis. The cable deflector of the second pulley assembly 200 can be adjusted in the same ways and with the same effect as disclosed above for the first pulley assembly 100. If the bow is a binary cam bow (FIG. 2), the pulley assemblies 100 and 200 each can further comprise a power cable let-out mechanism 180 (e.g., a concentric or eccentric let-out pulley, or an eccentrically mounted cable anchor; disclosed in various patents incorporated herein) substantially rigidly coupled to the draw cable pulley 110 or the power cable pulley 150. The power cable let-out mechanism 180 is structurally arranged to receive a corresponding one of the power cables and let out that power cable (during at least a portion of the draw) when the bow is drawn and the pulley assemblies 100 and 200 rotate.

If the bow is a solo cam bow (FIG. 3), the pulley assembly 100 can further comprise a draw cable let-out pulley 190 substantially rigidly coupled to the draw cable pulley 110 or the power cable pulley 150. The draw cable let-out pulley 190 is structurally arranged to receive a second end of the draw cable 30 in a circumferential draw cable journal and let out the second end of the draw cable, with the draw cable passing around an idler wheel (i.e., the second pulley assembly 200 rotatably mounted on the second bow limb 12) when the bow is drawn and the assemblies rotate about the corresponding pulley assembly axes. If the bow is a hybrid cam bow (FIG. 4), the pulley assembly 100 can be arranged similar to that of a solo cam bow, except that the cable received by and let out by the pulley 190 is an additional coupling cable 33 that is taken up by the second pulley assembly 200 as the bow is drawn.

Some examples of arrangements suitable for dual, binary, solo, or hybrid cam bows are disclosed in co-owned U.S. Pat. Nos. 7,305,979; 7,770,568; 8,181,638; 8,469,013; 8,739,769; 9,347,730; 9,417,028; 9,441,907; 9,506,714; and 9,739,562. One or two inventive pulley assemblies disclosed herein (i.e., that include a cable deflector 300) can be advantageously employed in any of those examples. Each one of those patents is incorporated by reference as if fully set forth herein.

Figure 9A:
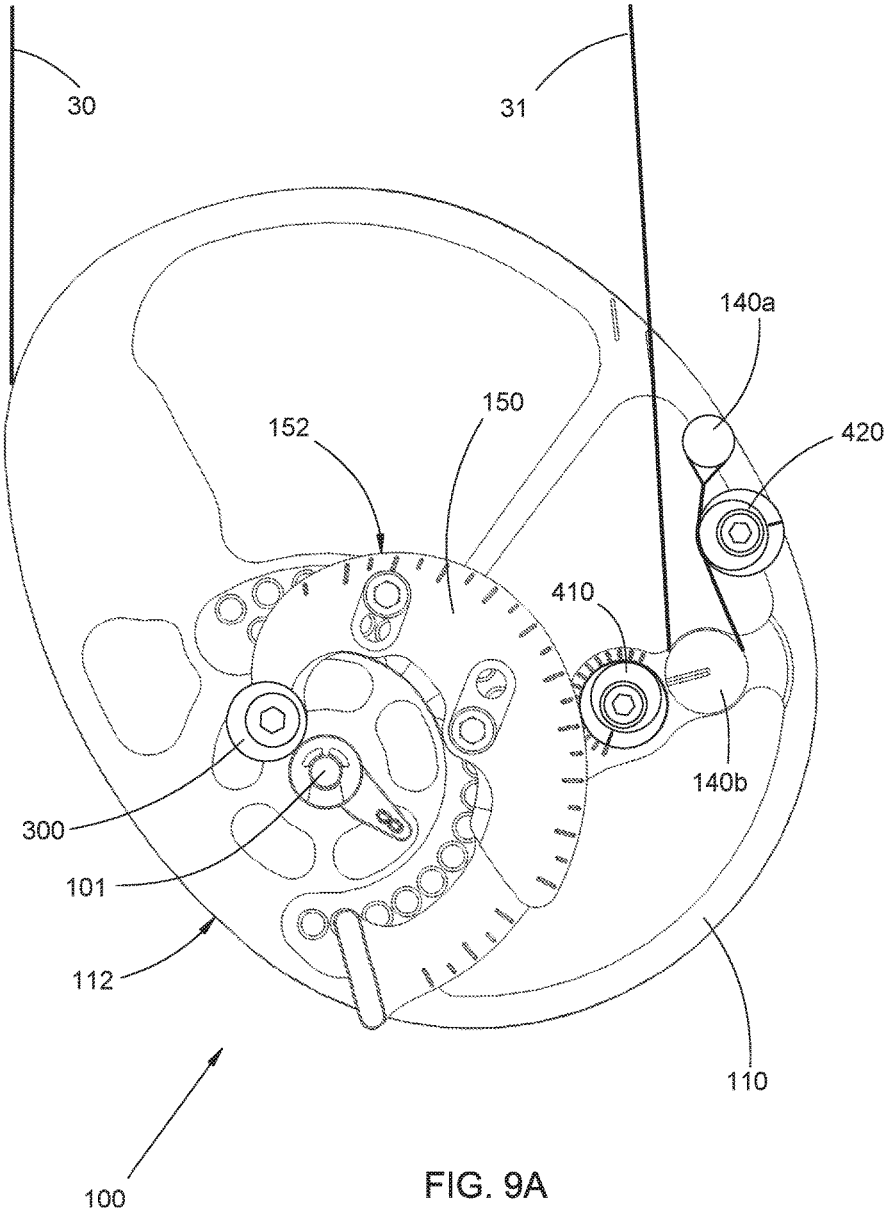
FIGS. 9A and 9B are schematic side views of another example inventive pulley assembly with the bow at brace and full draw, respectively.
Figure 9B:
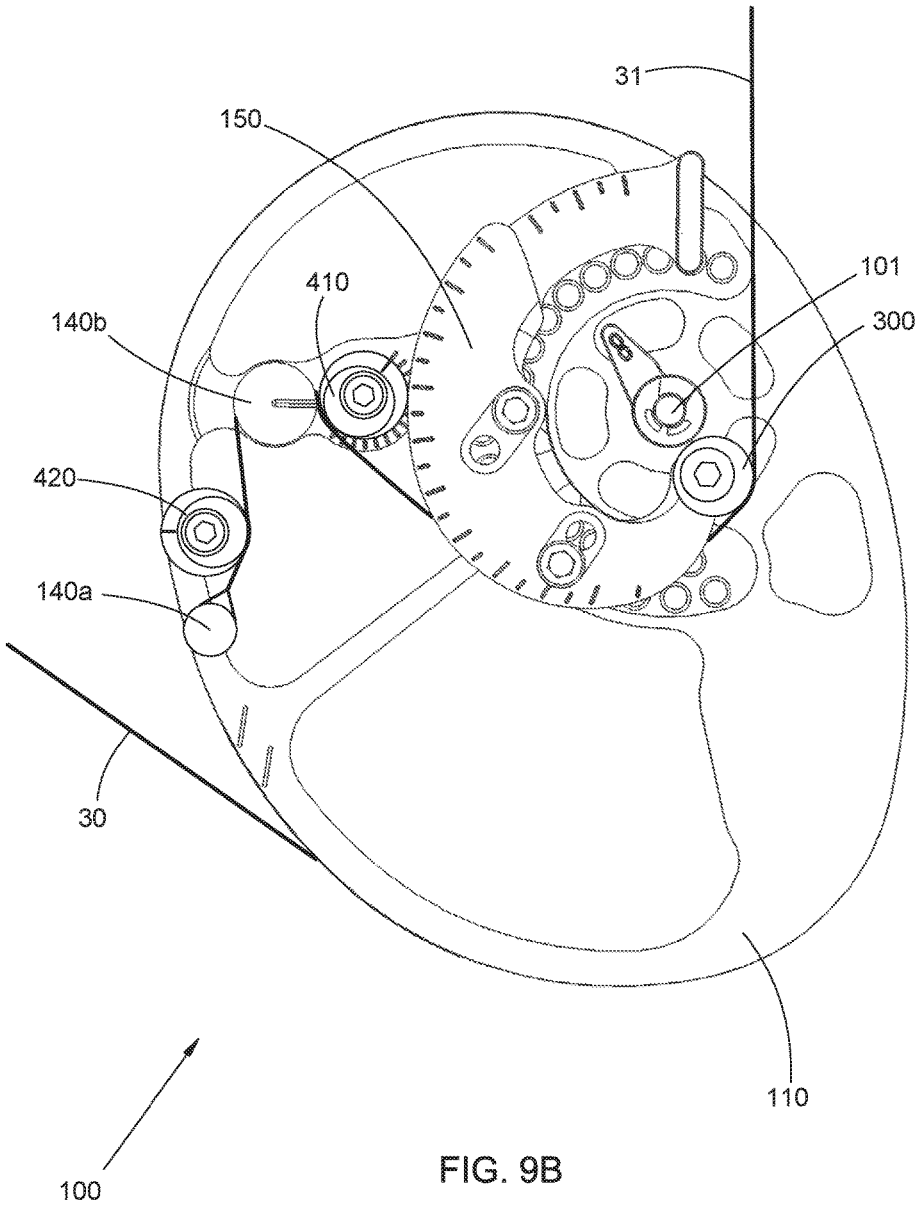

In some examples (e.g., as in FIGS. 9A and 9B), the inventive pulley assembly 100 can include one or more adjustable cable deflectors 410 or 420 substantially rigidly attached to the draw cable pulley 110, e.g., as disclosed in U.S. Pat. No. 9,441,907 or 9,739,562. Each such additional cable deflector 410 or 420 can be substantially rigidly attached to the draw cable pulley 110 in any one of a set of multiple additional deflector arrangements. In one or more of the multiple additional deflector arrangements, the additional cable deflector deflects laterally, by a corresponding non-negligible amount relative to an undeflected power cable path, a segment of the power cable between the power cable pulley 150 and the power cable anchor 140*a* on the draw cable pulley 110. The corresponding non-negligible amount of lateral deflection differs from an amount of lateral deflection of at least one other of the multiple additional deflector arrangements. In some examples, at least one of the additional deflector arrangements results in no lateral deflection, or only a negligible amount of lateral deflection, of the power cable segment.

In some examples that include the additional cable deflector 410 (i.e., wherein the additional cable deflector 410 is arranged as disclosed in U.S. Pat. No. 9,441,907), in any one of the multiple additional deflector arrangements, with the bow at brace, the additional cable deflector causes no lateral deflection, or only negligible lateral deflection, of the power cable segment (e.g., as in FIG. 9A). The additional cable deflector 410 deflects laterally the power cable segment during only a later phase of drawing the bow (e.g., as in FIG. 9B). By moving the additional cable deflector 410 from one additional deflector arrangement to another, relative synchronization of the pulley assemblies 100 and 200 can be altered for only a later portion of drawing of the bow.

In some examples that include the additional cable deflector 420 (i.e., wherein the additional cable deflector 420 is arranged as disclosed in U.S. Pat. No. 9,739,562), in any one of the multiple additional deflector arrangements, each corresponding negligible or non-negligible amount of lateral deflection of the power cable segment remains substantially constant throughout drawing of the bow. By moving the additional cable deflector 420 from one additional deflector arrangement to another, relative synchronization of the pulley assemblies 100 and 200 can be altered with the bow at brace.

In some examples, both additional cable deflectors 410 and 420 can be used together on a single pulley assembly 100.

In addition to the preceding, the following examples fall within the scope of the present disclosure or appended claims:

Example 1

A pulley assembly for a compound archery bow, the pulley assembly comprising a draw cable pulley, a power cable pulley substantially rigidly attached to the draw cable pulley, and an adjustable cable deflector substantially rigidly attached to the power cable pulley or the draw cable pulley, wherein: (a) the draw cable pulley is structurally arranged so as to (i) define a first pulley assembly transverse rotation axis, (ii) be mounted on a first limb of an archery bow to rotate about the first pulley assembly axis, and (iii) let out, from a circumferential draw cable journal of the draw cable pulley, a draw cable of the archery bow when the bow is drawn and the draw cable pulley rotates about the first pulley assembly axis; (b) the power cable pulley is structurally arranged and positioned on the draw cable pulley so as to take up, during at least a portion of drawing of the bow, into a circumferential power cable journal of the power cable pulley, a power cable of the archery bow; (c) one or more of the cable deflector, the power cable pulley, or the draw cable pulley are structurally arranged so as to enable substantially rigid attachment of the cable deflector to the power cable pulley or the draw cable pulley in any one of a set of multiple deflector arrangements; (d) for at least one of the multiple deflector arrangements, the power cable pulley and the cable deflector are structurally arranged so that the cable deflector engages the power cable for further take-up thereof during a let-off portion of drawing of the bow after the power cable is taken up by the power cable pulley; and (e) the power cable pulley and the cable deflector are structurally arranged so that at least two of the multiple deflector arrangements result in corresponding draw force curves for the bow that differ from one another with respect to one or both of (i) draw force let-off rate with respect to draw distance or (ii) hold weight at full draw.

Example 2

The pulley assembly of Example 1 wherein the power cable pulley and the cable deflector are arranged so that, during a let-off portion of drawing of the bow, at least two of the multiple deflector arrangements differ from one another with respect to the let-off rate.

Example 3

The pulley assembly of any one of Examples 1 or 2 wherein the power cable pulley and the cable deflector are arranged so that, during a let-off portion of drawing of the bow, at least two of the multiple deflector arrangements differ from one another with respect to a rate of decrease, with respect to draw distance, of an effective lever arm for take-up of the power cable.

Example 4

The pulley assembly of any one of Examples 1 through 3 wherein the power cable pulley and the cable deflector are arranged so that, at full draw of the bow, at least two of the multiple deflector arrangements differ from one another with respect to the hold weight.

Example 5

The pulley assembly of any one of Examples 1 through 4 wherein the power cable pulley and the cable deflector are arranged so that, at full draw of the bow, at least two of the multiple deflector arrangements differ from one another with respect to an effective lever arm for take-up of the power cable.

Example 6

The pulley assemble of any one of Examples 1 through 5 wherein the power cable pulley and the cable deflector are arranged so that, for two or more of the multiple deflector arrangements, (i) the cable deflector engages the power cable during a let-off portion of drawing of the bow after the power cable is taken up by the power cable pulley, and (ii) the two or more of the multiple deflector arrangements result in corresponding draw force curves for the bow that differ from one another with respect to the let-off rate or the hold weight.

Example 7

The pulley assembly of any one of Examples 1 through 6 wherein the power cable pulley and the cable deflector are arranged so that, for at least one of the multiple deflector arrangements, (i) the cable deflector does not engage the power cable during any portion of drawing of the bow, and (ii) the at least one of the multiple deflector arrangements results in a corresponding draw force curve that differs from a corresponding draw force curve of at least one other of the multiple deflector arrangements with respect to the let-off rate or the hold weight.

Example 8

The pulley assembly of any one of Examples 1 through 7 wherein the set of multiple deflector arrangements comprises a set of multiple, discrete positions or orientations of the cable deflector relative to the power cable pulley or the draw cable pulley.

Example 9

The pulley assembly of Example 8 wherein one or more of the cable deflector, the power cable pulley, or the draw cable pulley are structurally arranged so as to provide mechanical indexing of each one of the multiple, discrete positions or orientations of the cable deflector relative to the power cable pulley or the draw cable pulley.

Example 10

The pulley assembly of any one of Examples 1 through 7 wherein the set of multiple deflector arrangements comprises a continuous range of positions or orientations of the cable deflector relative to the power cable pulley or the draw cable pulley.

Example 11

The pulley assembly of any one of Examples 1 through 10 wherein: (f) the cable deflector comprises a concentric mounting portion and an eccentric deflector portion; (g) one or both of the power cable pulley or the draw cable pulley are structurally arranged so as to engage the concentric mounting portion of the cable deflector in any one of a set of multiple relative rotational positions; and (h) each relative rotational position of the concentric mounting portion corresponds to one of the multiple deflector arrangements.

Example 12

The pulley assembly of any one of Examples 1 through 11 wherein one or both of the draw cable pulley and the power cable pulley are structurally arranged so as to enable substantially rigid attachment of the power cable pulley to the draw cable pulley in any one of multiple power cable pulley arrangements.

Example 13

The pulley assembly of any one of Examples 1 through 12 wherein the pulley assembly further comprises a cable let-out pulley substantially rigidly attached to the draw cable pulley or the power cable pulley, wherein the cable let-out pulley is structurally arranged so as to let out from a circumferential journal of the let-out pulley an additional cable of the archery bow when the bow is drawn and the draw cable pulley rotates about the first pulley assembly axis.

Example 14

The pulley assembly of any one of Examples 1 through 13 further comprising an additional adjustable cable deflector substantially rigidly attached to the draw cable pulley, wherein: (f) one or both of the additional cable deflector or the draw cable pulley are structurally arranged so as to enable substantially rigid attachment of the additional cable deflector to the draw cable pulley in any one of a set of multiple additional deflector arrangements; and (g) in one or more of the multiple additional deflector arrangements, the additional cable deflector is positioned and arranged so as to deflect laterally, by a corresponding non-negligible amount relative to an undeflected power cable path, a segment of the power cable between the power cable pulley and a power cable anchor on the draw cable pulley, with the corresponding non-negligible amount of lateral deflection differing from an amount of lateral deflection of at least one other of the multiple additional deflector arrangements.

Example 15

The pulley assembly of Example 14 wherein, in at least one of the multiple additional deflector arrangements, the additional cable deflector causes no lateral deflection, or only a negligible amount of lateral deflection, of the power cable segment.

Example 16

The pulley assembly of any one of Examples 14 or 15 wherein the pulley assembly is arranged so that: (h) in any one of the multiple additional deflector arrangements, with the bow at brace, the additional cable deflector causes no lateral deflection, or only negligible lateral deflection, of the power cable segment; and (i) in one or more of the multiple additional deflector arrangements, the additional cable deflector is positioned and arranged so as to deflect laterally the power cable segment, during only a later phase of drawing the bow, by the corresponding non-negligible amount relative to the undeflected power cable path.

Example 17

The pulley assembly of any one of Examples 14 or 15 wherein the pulley assembly is arranged so that each corresponding negligible or non-negligible amount of lateral deflection remains substantially constant throughout drawing of the bow.

Example 18

A method for adjusting the pulley assembly of Example 17, the method comprising moving the additional cable deflector from a first one of the multiple additional deflector arrangements and substantially rigidly attaching the additional cable deflector to the draw cable pulley in a second, different one of the multiple additional deflector arrangements, thereby altering relative synchronization, with the bow at brace, of the pulley assembly with a second pulley assembly mounted on a second limb of the archery bow.

Example 19

A method for adjusting the pulley assembly of Example 16, the method comprising moving the additional cable deflector from a first one of the multiple additional deflector arrangements and substantially rigidly attaching the additional cable deflector to the draw cable pulley in a second, different one of the multiple additional deflector arrangements, thereby altering relative synchronization, during only a later portion of drawing of the bow, of the pulley assembly with a second pulley assembly mounted on a second limb of the archery bow.

Example 20

A method for adjusting the pulley assembly of any one of Examples 1 through 17, the method comprising moving the cable deflector from a first one of the multiple deflector arrangements and substantially rigidly attaching the cable deflector to the power cable pulley or the draw cable pulley in a second, different one of the multiple deflector arrangements, thereby altering one or both of the let-off rate or the hold weight.

Example 21

The method of Example 20 wherein the cable deflector is moved and attached, with the pulley assembly mounted on the bow and with the bow rigged with draw cable and the power cable, without using a bow press and without derigging the bow.

Example 22

A compound archery bow comprising a central riser, first and second bow limbs secured to opposing ends of the riser, first and second pulley assemblies rotatably mounted on the first and second bow limbs, respectively, a draw cable, and a power cable, wherein the first pulley assembly is arranged according to any one of Examples 1 through 17.

Example 23

A compound archery bow comprising a central riser, first and second bow limbs secured to opposing ends of the riser, first and second pulley assemblies rotatably mounted on the first and second bow limbs, respectively, a draw cable, and a first power cable, wherein: (a) the first pulley assembly comprises a first draw cable pulley, a first power cable pulley substantially rigidly attached to the first draw cable pulley, and a first adjustable cable deflector substantially rigidly attached to the first power cable pulley or the first draw cable pulley; (b) the first draw cable pulley is structurally arranged so as to (i) define a first pulley assembly transverse rotation axis, (ii) be mounted on the first limb to rotate about the first pulley assembly axis, and (iii) let out, from a circumferential draw cable journal of the first draw cable pulley, the draw cable when the bow is drawn and the first draw cable pulley rotates about the first pulley assembly axis; (c) the first power cable pulley is structurally arranged and positioned on the first draw cable pulley so as to take up, during at least a portion of drawing of the bow, into a circumferential power cable journal of the first power cable pulley, the first power cable; (d) one or more of the first cable deflector, the first power cable pulley, or the first draw cable pulley are structurally arranged so as to enable substantially rigid attachment of the first cable deflector to the first power cable pulley or the first draw cable pulley in any one of a set of multiple first deflector arrangements; (e) for at least one of the multiple first deflector arrangements, the first power cable pulley and the first cable deflector are structurally arranged so that the first cable deflector engages the first power cable for further take-up thereof during a let-off portion of drawing of the bow after the first power cable is taken up by the first power cable pulley; and (f) the first power cable pulley and the first cable deflector are structurally arranged so that at least two of the multiple first deflector arrangements result in corresponding draw force curves for the bow that differ from one another with respect to one or both of (i) draw force let-off rate with respect to draw distance or (ii) hold weight at full draw.

Example 24

The bow of any one of Examples 22 or 23 further comprising a second power cable, wherein: (g) the second pulley assembly comprises a second draw cable pulley, a second power cable pulley substantially rigidly attached to the second draw cable pulley, and a second adjustable cable deflector substantially rigidly attached to the second power cable pulley or the second draw cable pulley; (h) the second draw cable pulley is structurally arranged so as to (i) define a second pulley assembly transverse rotation axis, (ii) be mounted on the second limb to rotate about the second pulley assembly axis, and (iii) let out, from a circumferential draw cable journal of the second draw cable pulley, the draw cable when the bow is drawn and the second draw cable pulley rotates about the second pulley assembly axis; (i) the second power cable pulley is structurally arranged and positioned on the second draw cable pulley so as to take up, during at least a portion of drawing of the bow, into a circumferential power cable journal of the second power cable pulley, the second power cable; (j) one or more of the second cable deflector, the second power cable pulley, or the second draw cable pulley are structurally arranged so as to enable substantially rigid attachment of the second cable deflector to the second power cable pulley or the second draw cable pulley in any one of a set of multiple second deflector arrangements; (k) for at least one of the multiple second deflector arrangements, the second power cable pulley and the second cable deflector are structurally arranged so that the second cable deflector engages the second power cable for further take-up thereof during the let-off portion of drawing of the bow after the second power cable is taken up by the second power cable pulley; and (l) the second power cable pulley and the second cable deflector are structurally arranged so that at least two of the multiple second deflector arrangements result in corresponding draw force curves for the bow that differ from one another with respect to one or both of (i) draw force let-off rate with respect to draw distance or (ii) hold weight at full draw.

Example 25

The bow of Example 24 wherein: (m) the first pulley assembly further comprises a first power cable let-out pulley substantially rigidly attached to the first draw cable pulley or the first power cable pulley; (n) the first power cable let-out pulley is structurally arranged so as to let out from a circumferential power cable journal of the first power cable let-out pulley the second power cable when the bow is drawn and the first draw cable pulley rotates about the first pulley assembly axis; (o) the second pulley assembly further comprises a second power cable let-out pulley substantially rigidly attached to the second draw cable pulley or the second power cable pulley; and (p) the second power cable let-out pulley is structurally arranged so as to let out from a circumferential power cable journal of the second power cable let-out pulley the first power cable when the bow is drawn and the second draw cable pulley rotates about the second pulley assembly axis.

Example 26

The bow of any one of Examples 22 or 23 wherein the second pulley assembly includes a power cable let-out pulley that is structurally arranged so as to let out from a circumferential power cable journal of the power cable let-out pulley the first power cable when the bow is drawn and the second pulley assembly rotates about the second pulley assembly axis.

Example 27

The bow of any one of Examples 22 or 23 wherein: (g) the first pulley assembly further comprises a draw cable let-out pulley substantially rigidly attached to the first draw cable pulley or the first power cable pulley; (h) the second pulley assembly comprises an idler wheel; and (i) the draw cable let-out pulley is structurally arranged so as to let out from a circumferential draw cable journal of the draw cable let-out pulley a second end of the draw cable, with the draw cable passing around the idler wheel, when the bow is drawn and the draw cable pulley rotates about the first pulley assembly axis.

Example 28

The bow of any one of Examples 22 or 23 further comprising a coupling cable, wherein: (g) the first pulley assembly further comprises a coupling cable let-out pulley substantially rigidly attached to the first draw cable pulley or the first power cable pulley; (h) the second pulley assembly comprises a second draw cable pulley and a coupling cable take-up pulley; (i) the second draw cable pulley is structurally arranged so as to let out from a circumferential draw cable journal of the second draw cable pulley the draw cable when the bow is drawn and the second pulley assembly rotates about the second pulley assembly axis; (j) the coupling cable take-up pulley is structurally arranged so as to take up into a circumferential coupling cable journal of the coupling cable take-up pulley a first end of the coupling cable when the bow is drawn and the second pulley assembly rotates about the second pulley assembly axis; and (k) the coupling cable let-out pulley is structurally arranged so as to let out from a circumferential coupling cable journal of the coupling cable let-out pulley a second end of the coupling cable when the bow is drawn and the first draw cable pulley rotates about the first pulley assembly axis.

Example 29

A method for adjusting the bow of any one of Examples 22 through 28, the method comprising moving the first cable deflector from a first one of the multiple first deflector arrangements and substantially rigidly attaching the first cable deflector to the first power cable pulley or the first draw cable pulley in a second, different one of the multiple first deflector arrangements, thereby altering one or both of the let-off rate or the hold weight.

Example 30

The method of Example 29 wherein the first cable deflector is moved and attached without using a bow press and without derigging the bow.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

In the appended claims, any labelling of elements, steps, limitations, or other portions of a claim (e.g., first, second, etc., (a), (b), (c), etc., or (i), (ii), (iii), etc.) is only for purposes of clarity, and shall not be construed as implying any sort of ordering or precedence of the claim portions so labelled. If any such ordering or precedence is intended, it will be explicitly recited in the claim or, in some instances, it will be implicit or inherent based on the specific content of the claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A pulley assembly for a compound archery bow, the pulley assembly comprising a draw cable pulley, a power cable pulley substantially rigidly attached to the draw cable pulley, and an adjustable cable deflector substantially rigidly attached to the power cable pulley or the draw cable pulley, wherein:

(a) the draw cable pulley is structurally arranged so as to (i) define a first pulley assembly transverse rotation axis, (ii) be mounted on a first limb of an archery bow to rotate about the first pulley assembly axis, and (iii) let out, from a circumferential draw cable journal of the draw cable pulley, a draw cable of the archery bow when the bow is drawn and the draw cable pulley rotates about the first pulley assembly axis;

(b) the power cable pulley is structurally arranged and positioned on the draw cable pulley so as to take up, during at least a portion of drawing of the bow, into a circumferential power cable journal of the power cable pulley, a power cable of the archery bow;

(c) one or more of the cable deflector, the power cable pulley, or the draw cable pulley are structurally arranged so as to enable substantially rigid attachment of the cable deflector to the power cable pulley or the draw cable pulley in any one of a set of multiple deflector arrangements;

(d) for at least one of the multiple deflector arrangements, the power cable pulley and the cable deflector are structurally arranged so that the cable deflector engages the power cable for further take-up thereof during a let-off portion of drawing of the bow after the power cable is taken up by the power cable pulley; and (e) the power cable pulley and the cable deflector are structurally arranged so that at least two of the multiple deflector arrangements result in corresponding draw force curves for the bow that differ from one another with respect to one or both of (i) draw force let-off rate with respect to draw distance or (ii) hold weight at full draw.

2. A method for adjusting the pulley assembly of claim 1, the method comprising moving the cable deflector from a first one of the multiple deflector arrangements and substantially rigidly attaching the cable deflector to the power cable pulley or the draw cable pulley in a second, different one of the multiple deflector arrangements, thereby altering one or both of the let-off rate or the hold weight.

3. The method of claim 2 wherein the cable deflector is moved and attached, with the pulley assembly mounted on the bow and with the bow rigged with draw cable and the power cable, without using a bow press and without derigging the bow.

4. The pulley assembly of claim 1 wherein the power cable pulley and the cable deflector are arranged so that, during a let-off portion of drawing of the bow, at least two of the multiple deflector arrangements differ from one another with respect to the let-off rate.

5. The pulley assembly of claim 1 wherein the power cable pulley and the cable deflector are arranged so that, during a let-off portion of drawing of the bow, at least two of the multiple deflector arrangements differ from one another with respect to a rate of decrease, with respect to draw distance, of an effective lever arm for take-up of the power cable.

6. The pulley assembly of claim 1 wherein the power cable pulley and the cable deflector are arranged so that, at full draw of the bow, at least two of the multiple deflector arrangements differ from one another with respect to the hold weight.

7. The pulley assembly of claim 1 wherein the power cable pulley and the cable deflector are arranged so that, at full draw of the bow, at least two of the multiple deflector arrangements differ from one another with respect to an effective lever arm for take-up of the power cable.

8. The pulley assemble of claim 1 wherein the power cable pulley and the cable deflector are arranged so that, for two or more of the multiple deflector arrangements, (i) the cable deflector engages the power cable during a let-off portion of drawing of the bow after the power cable is taken up by the power cable pulley, and (ii) the two or more of the multiple deflector arrangements result in corresponding draw force curves for the bow that differ from one another with respect to the let-off rate or the hold weight.

9. The pulley assembly of claim 1 wherein the power cable pulley and the cable deflector are arranged so that, for at least one of the multiple deflector arrangements, (i) the cable deflector does not engage the power cable during any portion of drawing of the bow, and (ii) the at least one of the multiple deflector arrangements results in a corresponding draw force curve that differs from a corresponding draw force curve of at least one other of the multiple deflector arrangements with respect to the let-off rate or the hold weight.

10. The pulley assembly of claim 1 wherein the set of multiple deflector arrangements comprises a set of multiple, discrete positions or orientations of the cable deflector relative to the power cable pulley or the draw cable pulley.

11. The pulley assembly of claim 10 wherein one or more of the cable deflector, the power cable pulley, or the draw cable pulley are structurally arranged so as to provide mechanical indexing of each one of the multiple, discrete positions or orientations of the cable deflector relative to the power cable pulley or the draw cable pulley.

12. The pulley assembly of claim 1 wherein the set of multiple deflector arrangements comprises a continuous range of positions or orientations of the cable deflector relative to the power cable pulley or the draw cable pulley.

13. The pulley assembly of claim 1 wherein:

(f) the cable deflector comprises a concentric mounting portion and an eccentric deflector portion;

(g) one or both of the power cable pulley or the draw cable pulley are structurally arranged so as to engage the concentric mounting portion of the cable deflector in any one of a set of multiple relative rotational positions; and (h) each relative rotational position of the concentric mounting portion corresponds to one of the multiple deflector arrangements.

14. The pulley assembly of claim 1 further comprising an additional adjustable cable deflector substantially rigidly attached to the draw cable pulley, wherein:

(f) one or both of the additional cable deflector or the draw cable pulley are structurally arranged so as to enable substantially rigid attachment of the additional cable deflector to the draw cable pulley in any one of a set of multiple additional deflector arrangements; and (g) in one or more of the multiple additional deflector arrangements, the additional cable deflector is positioned and arranged so as to deflect laterally, by a corresponding non-negligible amount relative to an undeflected power cable path, a segment of the power cable between the power cable pulley and a power cable anchor on the draw cable pulley, with the corresponding non-negligible amount of lateral deflection differing from an amount of lateral deflection of at least one other of the multiple additional deflector arrangements.

15. The pulley assembly of claim 14 wherein, in at least one of the multiple additional deflector arrangements, the additional cable deflector causes no lateral deflection, or only a negligible amount of lateral deflection, of the power cable segment.

16. The pulley assembly of claim 14 wherein the pulley assembly is arranged so that:

(h) in any one of the multiple additional deflector arrangements, with the bow at brace, the additional cable deflector causes no lateral deflection, or only negligible lateral deflection, of the power cable segment; and (i) in one or more of the multiple additional deflector arrangements, the additional cable deflector is positioned and arranged so as to deflect laterally the power cable segment, during only a later phase of drawing the bow, by the corresponding non-negligible amount relative to the undeflected power cable path.

17. A method for adjusting the pulley assembly of claim 16, the method comprising moving the additional cable deflector from a first one of the multiple additional deflector arrangements and substantially rigidly attaching the additional cable deflector to the draw cable pulley in a second, different one of the multiple additional deflector arrangements, thereby altering relative synchronization, during only a later portion of drawing of the bow, of the pulley assembly with a second pulley assembly mounted on a second limb of the archery bow.

18. The pulley assembly of claim 14 wherein the pulley assembly is arranged so that each corresponding negligible or non-negligible amount of lateral deflection remains substantially constant throughout drawing of the bow.

19. A method for adjusting the pulley assembly of claim 18, the method comprising moving the additional cable deflector from a first one of the multiple additional deflector arrangements and substantially rigidly attaching the additional cable deflector to the draw cable pulley in a second, different one of the multiple additional deflector arrangements, thereby altering relative synchronization, with the bow at brace, of the pulley assembly with a second pulley assembly mounted on a second limb of the archery bow.

20. The pulley assembly of claim 1 wherein one or both of the draw cable pulley and the power cable pulley are structurally arranged so as to enable substantially rigid attachment of the power cable pulley to the draw cable pulley in any one of multiple power cable pulley arrangements.

21. The pulley assembly of claim 1 wherein the pulley assembly further comprises a cable let-out pulley substantially rigidly attached to the draw cable pulley or the power cable pulley, wherein the cable let-out pulley is structurally arranged so as to let out from a circumferential journal of the let-out pulley an additional cable of the archery bow when the bow is drawn and the draw cable pulley rotates about the first pulley assembly axis.

22. A compound archery bow comprising a central riser, first and second bow limbs secured to opposing ends of the riser, first and second pulley assemblies rotatably mounted on the first and second bow limbs, respectively, a draw cable, and a first power cable, wherein:

(a) the first pulley assembly comprises a first draw cable pulley, a first power cable pulley substantially rigidly attached to the first draw cable pulley, and a first adjustable cable deflector substantially rigidly attached to the first power cable pulley or the first draw cable pulley;

(b) the first draw cable pulley is structurally arranged so as to (i) define a first pulley assembly transverse rotation axis, (ii) be mounted on the first limb to rotate about the first pulley assembly axis, and (iii) let out, from a circumferential draw cable journal of the first draw cable pulley, the draw cable when the bow is drawn and the first draw cable pulley rotates about the first pulley assembly axis;

(c) the first power cable pulley is structurally arranged and positioned on the first draw cable pulley so as to take up, during at least a portion of drawing of the bow, into a circumferential power cable journal of the first power cable pulley, the first power cable;

(d) one or more of the first cable deflector, the first power cable pulley, or the first draw cable pulley are structurally arranged so as to enable substantially rigid attachment of the first cable deflector to the first power cable pulley or the first draw cable pulley in any one of a set of multiple first deflector arrangements;

(e) for at least one of the multiple first deflector arrangements, the first power cable pulley and the first cable deflector are structurally arranged so that the first cable deflector engages the first power cable for further take-up thereof during a let-off portion of drawing of the bow after the first power cable is taken up by the first power cable pulley; and (f) the first power cable pulley and the first cable deflector are structurally arranged so that at least two of the multiple first deflector arrangements result in corresponding draw force curves for the bow that differ from one another with respect to one or both of (i) draw force let-off rate with respect to draw distance or (ii) hold weight at full draw.

23. A method for adjusting the bow of claim 22, the method comprising moving the first cable deflector from a first one of the multiple first deflector arrangements and substantially rigidly attaching the first cable deflector to the first power cable pulley or the first draw cable pulley in a second, different one of the multiple first deflector arrangements, thereby altering one or both of the let-off rate or the hold weight.

24. The method of claim 23 wherein the first cable deflector is moved and attached without using a bow press and without derigging the bow.

25. The bow of claim 22 further comprising a second power cable, wherein:

(g) the second pulley assembly comprises a second draw cable pulley, a second power cable pulley substantially rigidly attached to the second draw cable pulley, and a second adjustable cable deflector substantially rigidly attached to the second power cable pulley or the second draw cable pulley;

(h) the second draw cable pulley is structurally arranged so as to (i) define a second pulley assembly transverse rotation axis, (ii) be mounted on the second limb to rotate about the second pulley assembly axis, and (iii) let out, from a circumferential draw cable journal of the second draw cable pulley, the draw cable when the bow is drawn and the second draw cable pulley rotates about the second pulley assembly axis;

(i) the second power cable pulley is structurally arranged and positioned on the second draw cable pulley so as to take up, during at least a portion of drawing of the bow, into a circumferential power cable journal of the second power cable pulley, the second power cable;

(j) one or more of the second cable deflector, the second power cable pulley, or the second draw cable pulley are structurally arranged so as to enable substantially rigid attachment of the second cable deflector to the second power cable pulley or the second draw cable pulley in any one of a set of multiple second deflector arrangements;

(k) for at least one of the multiple second deflector arrangements, the second power cable pulley and the second cable deflector are structurally arranged so that the second cable deflector engages the second power cable for further take-up thereof during the let-off portion of drawing of the bow after the second power cable is taken up by the second power cable pulley; and (l) the second power cable pulley and the second cable deflector are structurally arranged so that at least two of the multiple second deflector arrangements result in corresponding draw force curves for the bow that differ from one another with respect to one or both of (i) draw force let-off rate with respect to draw distance or (ii) hold weight at full draw.

26. The bow of claim 25 wherein:

(m) the first pulley assembly further comprises a first power cable let-out pulley substantially rigidly attached to the first draw cable pulley or the first power cable pulley;

(n) the first power cable let-out pulley is structurally arranged so as to let out from a circumferential power cable journal of the first power cable let-out pulley the second power cable when the bow is drawn and the first draw cable pulley rotates about the first pulley assembly axis;

(o) the second pulley assembly further comprises a second power cable let-out pulley substantially rigidly attached to the second draw cable pulley or the second power cable pulley; and (p) the second power cable let-out pulley is structurally arranged so as to let out from a circumferential power cable journal of the second power cable let-out pulley the first power cable when the bow is drawn and the second draw cable pulley rotates about the second pulley assembly axis.

27. The bow of claim 22 wherein the second pulley assembly includes a power cable let-out pulley that is structurally arranged so as to let out from a circumferential power cable journal of the power cable let-out pulley the power cable when the bow is drawn and the second pulley assembly rotates about the second pulley assembly axis.

28. The bow of claim 22 wherein:

(g) the first pulley assembly further comprises a draw cable let-out pulley substantially rigidly attached to the first draw cable pulley or the first power cable pulley;

(h) the second pulley assembly comprises an idler wheel; and (i) the draw cable let-out pulley is structurally arranged so as to let out from a circumferential draw cable journal of the draw cable let-out pulley a second end of the draw cable, with the draw cable passing around the idler wheel, when the bow is drawn and the draw cable pulley rotates about the first pulley assembly axis.

29. The bow of claim 22 further comprising a coupling cable, wherein:

(g) the first pulley assembly further comprises a coupling cable let-out pulley substantially rigidly attached to the first draw cable pulley or the first power cable pulley;

(h) the second pulley assembly comprises a second draw cable pulley and a coupling cable take-up pulley;

(i) the second draw cable pulley is structurally arranged so as to let out from a circumferential draw cable journal of the second draw cable pulley the draw cable when the bow is drawn and the second pulley assembly rotates about the second pulley assembly axis;

(j) the coupling cable take-up pulley is structurally arranged so as to take up into a circumferential coupling cable journal of the coupling cable take-up pulley a first end of the coupling cable when the bow is drawn and the second pulley assembly rotates about the second pulley assembly axis; and (k) the coupling cable let-out pulley is structurally arranged so as to let out from a circumferential coupling cable journal of the coupling cable let-out pulley a second end of the coupling cable when the bow is drawn and the first draw cable pulley rotates about the first pulley assembly axis.

* * * * *